US008584648B2

(12) United States Patent
Chiera et al.

(10) Patent No.: US 8,584,648 B2
(45) Date of Patent: Nov. 19, 2013

(54) CONTROLLED SPARK IGNITED FLAME KERNEL FLOW

(71) Applicants: Domenico Chiera, Fort Collins, CO (US); Gregory James Hampson, Boulder, CO (US)

(72) Inventors: Domenico Chiera, Fort Collins, CO (US); Gregory James Hampson, Boulder, CO (US)

(73) Assignee: Woodward, Inc.

( * ) Notice: Subject to any disclaimer, the term of this patent is extended or adjusted under 35 U.S.C. 154(b) by 0 days.

(21) Appl. No.: 13/833,226

(22) Filed: Mar. 15, 2013

(65) Prior Publication Data

US 2013/0206122 A1 Aug. 15, 2013

Related U.S. Application Data

(63) Continuation-in-part of application No. 13/042,599, filed on Mar. 8, 2011, which is a continuation-in-part of application No. 13/347,448, filed on Jan. 10, 2012.

(60) Provisional application No. 61/416,588, filed on Nov. 23, 2010.

(51) Int. Cl.

| | |
|---|---|
| ***F02F 1/00*** | (2006.01) |
| ***F02B 19/00*** | (2006.01) |
| ***F02B 19/18*** | (2006.01) |
| ***F02M 57/06*** | (2006.01) |
| ***H01T 13/24*** | (2006.01) |
| ***H01T 13/46*** | (2006.01) |
| ***H01T 13/20*** | (2006.01) |

(52) U.S. Cl.

USPC ..... 123/266; 123/253; 123/255; 123/260; 313/118; 313/135; 313/138; 313/139; 313/141

(58) Field of Classification Search

USPC ..... 123/254, 255, 256, 260, 266, 287, 123/196 R; 313/118, 122, 123, 135, 138, 313/139, 140, 141, 142, 143; 60/303; 29/592.1; 445/7

See application file for complete search history.

(56) References Cited

U.S. PATENT DOCUMENTS

| | | | | | |
|---|---|---|---|---|---|
| 1,009,867 | A | * | 11/1911 | Terry | 313/139 |
| 1,360,294 | A | * | 11/1920 | Hill | 313/142 |
| 1,361,347 | A | * | 12/1920 | Nighswander | 313/126 |
| 1,538,750 | A | * | 5/1925 | Scognamillo | 313/122 |
| 1,963,801 | A | * | 6/1934 | O'Marra | 313/120 |
| 2,047,575 | A | * | 7/1936 | Burtnett | 313/143 |
| 2,208,030 | A | * | 7/1940 | Holmes | 313/157 |
| 2,314,128 | A | | 3/1943 | Coldwell | |
| 2,586,864 | A | * | 2/1952 | Rose | 313/140 |
| 2,843,780 | A | * | 7/1958 | Harper | 313/143 |
| 3,958,144 | A | | 5/1976 | Franks | |

(Continued)

FOREIGN PATENT DOCUMENTS

| | | | |
|---|---|---|---|
| DE | 3230793 | A1 * | 2/1984 |
| DE | 3913665 | A1 * | 10/1990 |

*Primary Examiner* — Stephen K Cronin
*Assistant Examiner* — Raza Najmuddin
(74) *Attorney, Agent, or Firm* — Fish & Richardson P.C.

(57) ABSTRACT

In some aspects, a spark plug includes a spark gap in an enclosure of the spark plug. The spark plug includes a passage in the interior of the enclosure. During operation of the engine, the passage directs flow through the spark gap, primarily away from a combustion chamber end of the enclosure. The passage can direct flow at a velocity of 5 meters/second or greater.

20 Claims, 21 Drawing Sheets
(4 of 21 Drawing Sheet(s) Filed in Color)

(56) References Cited

U.S. PATENT DOCUMENTS

| | | | | |
|---|---|---|---|---|
| 5,105,780 | A * | 4/1992 | Richardson | 123/263 |
| 5,107,168 | A | 4/1992 | Friedrich et al. | |
| 5,369,328 | A | 11/1994 | Gruber et al. | |
| 5,408,961 | A * | 4/1995 | Smith | 123/169 R |
| 6,460,506 | B1 * | 10/2002 | Nevinger | 123/260 |
| 6,495,948 | B1 | 12/2002 | Garrett, III | |
| 7,659,655 | B2 * | 2/2010 | Tozzi et al. | 313/143 |
| 7,922,551 | B2 * | 4/2011 | Tozzi | 445/7 |
| 8,143,772 | B2 * | 3/2012 | Francesconi | 313/118 |
| 8,261,711 | B2 * | 9/2012 | Shimoda | 123/169 EL |
| 2004/0061421 | A1 | 4/2004 | Morita et al. | |
| 2004/0100179 | A1 * | 5/2004 | Boley et al. | 313/143 |
| 2005/0000484 | A1 * | 1/2005 | Schultz et al. | 123/266 |
| 2005/0092285 | A1 | 5/2005 | Klonis et al. | |
| 2005/0211217 | A1 * | 9/2005 | Boley et al. | 123/266 |
| 2007/0069617 | A1 * | 3/2007 | Tozzi et al. | 313/140 |
| 2009/0309475 | A1 * | 12/2009 | Tozzi | 313/143 |
| 2010/0133977 | A1 * | 6/2010 | Kato | 313/141 |
| 2011/0062850 | A1 * | 3/2011 | Tozzi | 313/141 |
| 2012/0125279 | A1 | 5/2012 | Hampson et al. | |
| 2012/0125287 | A1 | 5/2012 | Chiera et al. | |
| 2013/0042834 | A9 | 2/2013 | Chiera et al. | |
| 2013/0055986 | A1 * | 3/2013 | Tozzi et al. | 123/254 |
| 2013/0099653 | A1 * | 4/2013 | Ernst | 313/140 |

* cited by examiner

CONTROLLED SPARK IGNITED FLAME KERNEL FLOW

CROSS-REFERENCE TO RELATED APPLICATIONS

This application is a continuation-in-part of, and claims the benefit of, co-pending U.S. patent application Ser. No. 13/042,599, filed Mar. 8, 2011, that claims the benefit of U.S. Provisional Patent Application No. 61/416,588, filed Nov. 23, 2010. This application is also a continuation-in-part of, and claims the benefit of, co-pending U.S. patent application Ser. No. 13/347,448, filed Jan. 10, 2012, that is a continuation-in-part of U.S. patent application Ser. No. 13/042,599, filed Mar. 8, 2011, that claims the benefit of U.S. Provisional Patent Application No. 61/416,588, filed Nov. 23, 2010.

BACKGROUND

This specification relates to spark plugs for internal combustion engines.

Engines operating on gaseous fuels, such as natural gas, are commonly supplied with a lean fuel mixture, which is a mixture of air and fuel containing an excess air beyond that which is "chemically correct" or stoichiometric. The lean fuel mixture often results in poor combustion such as misfires, incomplete combustion and poor fuel economy and often efforts to improve combustion lead to detonation or the use of high energy spark which leads to short spark plug life. One factor that can lead to such events is the poor ability of conventional spark plugs to effectively and consistently ignite a lean fuel mixture in the cylinder of the operating engine. More effective combustion of lean fuel mixtures can be achieved using a pre-combustion chamber, or pre-chamber.

Pre-chamber spark plugs are typically used to enhance the lean flammability limits in lean burn engines such as natural gas lean burn engines or automotive lean gasoline engines. In known pre-chamber spark plugs, such as the pre-chamber spark plug disclosed in U.S. Pat. No. 5,554,908, the spark gap is confined in a cavity having a volume that may represent a relatively small fraction of the total engine cylinder displacement. A portion of the cavity is shaped as a dome and has various tangential induction/ejection holes. During operation, as the engine piston moves upward during the compression cycle, air/fuel mixture is forced through the induction holes in the pre-chamber. The orientation of the holes may determine the motion of the air/fuel mixture inside of the pre-chamber cavity and the reacting jet upon exiting the pre-chamber.

When the burn rate of the air/fuel mixture in the pre-chamber cavity is increased, the result is more highly penetrating flame jets into the engine combustion chamber. These flame jets improve the ability of the engine to achieve a more rapid and repeatable flame propagation in the engine combustion chamber at leaner air/fuel mixtures. Many conventional pre-chamber spark plugs have non-repeatable and unpredictable performance characteristics which may lead to a higher than desired coefficient of variation (COV) and misfire, which is a measure of roughness. Further, many conventional pre-chamber spark plugs are sensitive to manufacturing variation and suffer from poor burned gas scavenging which further leads to increased COV.

One of the challenges in spark plug design is to create a plug capable of achieving a repeatable and controllable ignition delay time during the combustion process, in spite of the fact that, in internal combustion engines, the fresh charge will not usually be homogeneous or repeatable from cycle to cycle in many aspects (e.g., equivalence ratio, turbulence, temperature, residuals). It is also desirable to have a spark plug that is relatively insensitive to variations in manufacturing or components or the assembly thereof.

Another challenge in spark plug design is premature spark plug wear. Typically, premature spark plug wear is caused by a high combustion temperature of the stoichiometric mixture. It is not uncommon for a spark plug in high BMEP engine applications to last only 800 to 1000 hours before it needs to be replaced. This can lead to unscheduled downtime for the engine and therefore increased operational costs for the engine operator.

SUMMARY

In some aspects, a spark plug can generate high velocity flame jets with low COV and long operating life—the benefits of which may include faster combustion in the main chamber, leading to improved NOx versus fuel consumption (or efficiency) trade-offs.

In some aspects, a pre-chamber spark plug includes a metallic shell, an end cap attached to the shell, a center electrode and ground electrode. Additionally, the pre-chamber spark plug includes an insulator disposed within the shell. In some implementations, the center electrode has a first portion surrounded by the insulator, and a second portion that extends from the insulator into a pre-chamber. The pre-chamber volume is defined by the shell and end cap. In some implementations, the ground electrode is attached to the shell. In some implementations, the ground electrode includes an inner ring spaced in surrounding relation to the center electrode, an outer ring attached to the shell, and a plurality of spokes connecting the inner and outer rings. In some implementations, the ground electrode has a tubular shape which serves to protect the incoming central hole flow (primary) passing through the gap between the center and ground electrode from disturbances from the flow entering via lateral (secondary) holes. The tubular shape also directs the lateral hole flow behind the ground electrode at the periphery to join the spark kernel as it exits the gap. Additionally, the center electrode has an aerodynamic shape which improves the flow stream line through the gap from the center hole.

In another aspect, combustion in an internal combustion engine is facilitated. An air/fuel mixture is ignited in a pre-chamber of a pre-chamber spark plug. In a some implementations, igniting an air/fuel mixture in a pre-chamber includes providing a first port to permit the flow of a first amount of air/fuel mixture into a gap between the center and ground electrode with a predominant backward flow direction from the front chamber of the pre-chamber, and igniting the air/fuel mixture in the gap, wherein the ignition produces a flame kernel. Further, the flame kernel is transported to a back chamber of the pre-chamber, and a second port permits the flow of a secondary (lateral) amount of air/fuel mixture into the front chamber, such that the secondary amount of air/fuel mixture flows to the back chamber to be ignited by the flame kernel. The secondary flow may also have swirl which serves to spread the developing flame in the back chamber in the azimuthal direction such that azimuthal uniformity is improved and turbulence generated within the pre-chamber which further speeds combustion. The ignition of the first and second amounts of air/fuel mixture creates a pressure rise in the pre-chamber which causes a flame jet to issue from the first and second ports. The port hole size and angle can be controlled (e.g., improved or optimized in some instances) to maximize the flame jet velocity and penetration into the main chamber, thus enhancing combustion in the main chamber.

The hole size controls both the inflow and outflow. The hole size can be controlled (e.g., improved or optimized in some instances) to achieve the desired engine-specific ignition delay time, jet velocity, and flame jet penetration and thus main chamber combustion rates.

In yet another aspect, a pre-chamber spark plug includes a shell, and an end cap attached to the shell. Additionally, the pre-chamber spark plug includes an insulator disposed within the shell. In some implementations, a center electrode has a first portion surrounded by the insulator and a second portion that extends from the insulator into a pre-chamber. The pre-chamber is defined by the shell and end cap. In some implementations, a ground electrode is attached to the shell. In some implementations, the ground electrode includes an inner ring spaced in surrounding relation to the center electrode and a plurality of spokes projecting radially outward from the inner ring which holds the ring in place. In some implementations, the end of each spoke is attached to the shell.

In another aspect, a pre-chamber spark plug is manufactured. A ground electrode is attached to the shell. In some implementations, the ground electrode includes a tubular electrode. In some implementations, the tubular electrode has an inner ring located in surrounding relation to the center electrode.

In some implementations, precious metal (or noble metal) is attached to the center electrode and to the ground electrode that represents the sparking surface. The gap between the center electrode and the ground electrode is created with a gapping tool during manufacturing and assembly such that the gap is determined accurately during manufacturing and assembly, thus reducing the need for re-gapping after fabrication. In some implementations, the gapping tool is inserted between the center electrode and the ground electrode prior to final attachment of the ground electrode to the shell. In some instances, this gap is best maintained if this is the final heating step in the process. In some implementations, the spark gap is created after attachment of the ground electrode via electron beam (EB), water jet, or other suitable material removal method to create a precise high tolerance gap. The ideal new spark gap ranges from 0.15 mm to 0.35 mm.

In some implementations, the arrangement of a tubular ground electrode with a concentric center electrode having created conditions for flow through the gap to the back side of the ground electrode can be accomplished in a pre-chamber in the head design which does not require the shell of the spark plug, where the cylinder head pre-chamber takes the place of the spark plug shell wall. Additionally, fuel may be added to either the pre-chamber spark plug or the pre-chamber in the head device to further extend the lean operating limit. These are referred to as "fuel-fed" devices.

In another aspect, a pre-chamber spark plug includes a shell, an insulator, a center electrode, and a ground electrode. The shell includes a plurality of ventilation holes. The insulator is disposed within the shell. The center electrode is surrounded by the insulator and extends into a pre-chamber that is defined by the shell. The insulator is coaxial around the center electrode. The ground electrode is attached to the insulator and surrounds a distil end of the center electrode. The ground electrode includes a tubular ring spaced in surrounding relation to the center electrode, and has a radial offset circumferential extension extending axially past the distil end of the center electrode forming a geometry which serves as an aerodynamic ram region.

In another aspect, combustion in an internal combustion engine is facilitated. An air/fuel mixture is ignited in a pre-chamber of a pre-chamber spark plug. Igniting the air/fuel mixture includes providing a plurality of ventilation holes to permit a primary flow of an air/fuel mixture into a spark gap of the pre-chamber, and igniting the air/fuel mixture, wherein an ignition event produces a flame kernel. Next, the flame kernel is transported to a first stage of the pre-chamber wherein the first stage of the pre-chamber is defined by a cavity disposed between a ground electrode attached to an insulator that is coaxial to a center electrode which functions as a "flame holder" by creating a recirculation zone. After transporting the flame kernel into the first stage, a secondary flow of the air/fuel mixture is provided to the pre-chamber from the plurality of ventilation holes such that the secondary flow disperses throughout a second stage of the pre-chamber defined by a cavity disposed outside of the ground electrode attached to the insulator. Finally, the flame kernel travels from the first stage to the second stage igniting the secondary flow of the air/fuel mixture causing the flame to spread throughout the pre-chamber, burning the bulk of fuel in the pre-chamber, creating a large pressure rise and consequently a flame jet to issue from the plurality of ventilation holes.

In another aspect, a pre-chamber spark plug includes a shell, an insulator, a center electrode and a ground electrode. The insulator is disposed within the shell. The center electrode has a first portion surrounded by the insulator, and has a second portion that extends from the insulator into a pre-chamber, which is defined by the shell. The ground electrode is attached to the insulator and includes an inner ring spaced in surrounding relation to the center electrode forming a spark gap.

In some aspects, a laser light beam is focused at a location between the gap surfaces, instead of an electric spark, to heat the AFR to ignition temperatures and create a flame kernel with photons instead of electrons. Some implementations include a means to bring the light beam into and focus it into the gap region. The benefit of laser beam ignition is that it is far less sensitive to cylinder pressure conditions, whereas an electric spark requires higher voltage to achieve break-down and spark as the pressure increases. Laser ignition may enable ignition at pressures above the break-down voltage limits of conventional electric ignition systems.

Other aspects, objectives and advantages will become more apparent from the following detailed description and the accompanying drawings.

BRIEF DESCRIPTION OF THE DRAWINGS

The patent or application file contains at least one drawing executed in color. Copies of this patent or patent application publication with color drawing(s) will be provided by the Office upon request and payment of the necessary fee.

The accompanying drawings illustrate several aspects of the present disclosure. In the drawings.

The details of one or more implementations are set forth in the accompanying drawings and the description below. Other features, objects, and advantages will be apparent from the description and drawings, and from the claims.

DETAILED DESCRIPTION

The concepts herein relate to a pre-chamber spark plug. In some instances, aspects of the plug address challenges associated with providing a repeatable and controllable ignition delay time during the combustion process. In some examples, the spark plug achieves a more efficient combustion process and longer life. The pre-chamber spark plug can include, for example, a tubular velocity control tube to control the flame kernel development, ignition delay time, flame jet evolution, main combustion chamber burn rate, and may consequently improve engine performance. In some examples, the delay time refers to the period between the spark and that time when the combustion affects a volume sufficient to increase the pressure in the pre-chamber and in turn the main combustion chamber.

Figure 1:
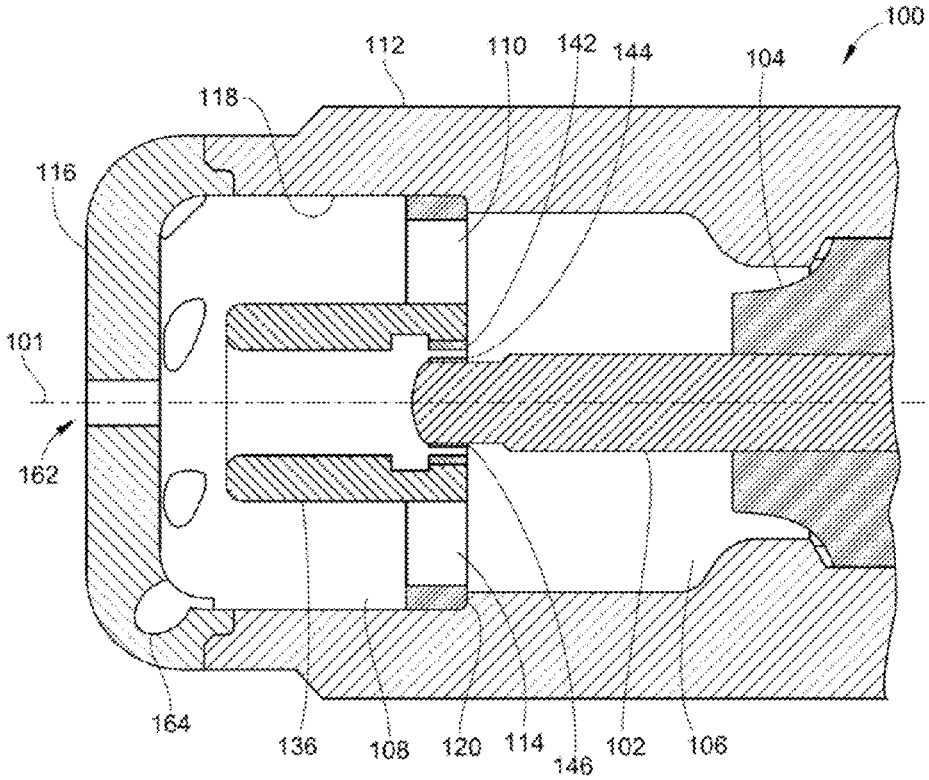
FIG. 1 illustrates a cross-sectional view of a portion of an example pre-chamber spark plug.

FIG. 1 illustrates a cross-sectional view of a portion of an example pre-chamber spark plug 100. The pre-chamber spark plug 100 has a longitudinal axis 101 and a center electrode 102 that extends along the longitudinal axis 101, and further extends from an insulator 104 into a pre-combustion chamber that is divided into a back chamber 106 and a front chamber 108. A tubular electrode 110, which serves as the ground electrode, is disposed inside a shell 112. Although shown in FIG. 1 as continuous (unbroken) cylinder, the tubular electrode 110 can be other tubular shapes (e.g., square tubing, triangular tubing, or other tubing) and, in certain instances, may match the axial cross section of the center electrode 102. In some implementations, the shell 112 is made from a high-strength metal capable of withstanding exposure to high temperatures. The shell 112 creates a portion of the pre-chamber volume of the spark plug 100. The shell 112 is attached to the insulator 104 and holds an end cap 116. The end cap 116 defines an end of the pre-chamber volume of the spark plug 100 and also a boundary of the front chamber 108. The end cap 116 can be flat, have a domed shape, a conical "V" shape, or another shape. In certain instances, the end cap 116 can be integrated into the shell 112, as opposed to being a separate piece attached to the shell 112 as is shown. The disk portion 114 of the tubular electrode 110 separates the back chamber 106 from the front chamber 108. As shown in FIG. 1, in some implementations, an interior surface 118 of the shell 112 may have a stepped portion 120 such that the tubular electrode 110 can seat on the stepped portion 120 during assembly of the pre-chamber spark plug 100.

Figure 2:
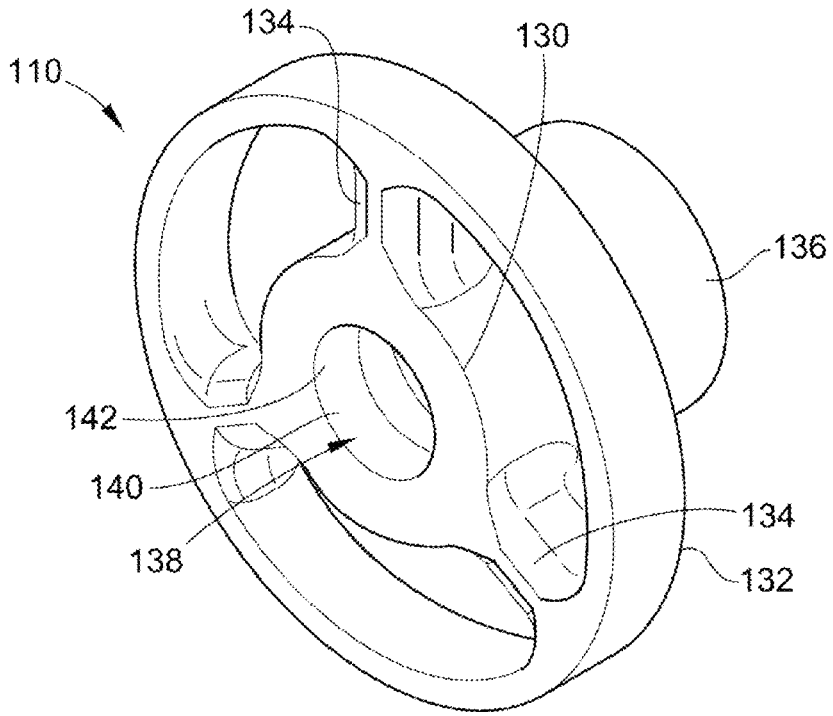
FIG. 2 is a perspective view of the example tubular electrode.

FIG. 2 is a perspective view of the example tubular electrode 110. The tubular electrode 110 has an inner ring 130 and an outer ring 132 imbedded within the tubular ground electrode 110. In the example of FIG. 2, the inner ring 130 and outer ring 132 are connected by three spokes 134. Extending from the inner ring 130 in the center portion of the tubular electrode 110 is a tubular inner ring, or velocity control tube 136. As illustrated in FIG. 1, the velocity control tube 136 extends away from the disk portion 114 in one direction into the front chamber 108. A central opening 138 extends through the inner ring 130 and the velocity control tube 136. In another example, the ground electrode 110 has another design, such as a J-shape forming a spark gap with the end or sidewall of the center electrode 102 with a tube or walls welded or otherwise attached on the front and/or back side to create a velocity control tube.

Still referring to FIG. 2, the example tubular electrode 110 can be made from a copper alloy, a nickel alloy, or some other relatively highly-conductive metal. In some implementations, a precious metal is attached to or deposited on an inner surface 140 of the inner ring 130. Precious metals are typically used on spark plug electrodes to increase the life of the spark plug and improve performance. The precious metals chosen for this application exhibit a high melting point, high conductivity, and increased resistance to oxidation. In some implementations, a first electrode surface ring 142 of, for example, platinum or alloys thereof, rhodium or alloys thereof, tungsten or alloys thereof, nickel or alloys thereof, iridium or alloys thereof lines the inner surface 140 of the inner ring 130. In some implementations, the inner surface 140 of the inner ring 130 is lined with an iridium-rhodium alloy or a nickel alloy. Referring again to FIG. 1, a second electrode surface ring 144, of the same or similar material as the first electrode surface ring 142, is attached to or deposited on an exterior surface 146 of the center electrode 102. The surface material makes up either the entire structural body of the center electrode 102 and/or the tubular electrode 110, or is attached via welding, brazing, or other suitable attachment method to the structural material. In the case of a ground electrode, the alternative spark surface material may be made in the shape of a tube which is press fit, brazed, or welded into the structural body of the ground electrode. The tubular electrode 110 may have a ring of a different material inserted inside the inner diameter of the base structure of the tubular electrode 110. The different material can be different than the base material of the tubular electrode 110, for example a different material that is highly resistant to erosion or oxidation. The purpose of the inserted ring is to increase the erosion resistance and oxidation resistance of the electrode by adding expensive erosion and oxidation resistant material only to the spark surface.

Referring again to FIG. 2, the example spokes 134 may be square-edged for easy manufacturing or may have a curved contour so as to provide less resistance to gases flowing through the spaces between the spokes 134. The supporting structure for the tubular electrode 110 may be a solid "wheel" type with spokes or any other mechanism to support the tubular electrode 110 concentric with the center electrode 102. Example supporting mechanisms include tabs or legs affixed to a sidewall, rear wall, or other part of the shell 112. In some instances, there may be a greater or a fewer number of spokes connecting the inner ring 130 and outer ring 132. In some instances, the tubular electrode 110 does not have an electrode surface ring made from a precious metal. In some examples, the entire tubular electrode 110 is made from a single material such as a nickel alloy.

Figure 3:
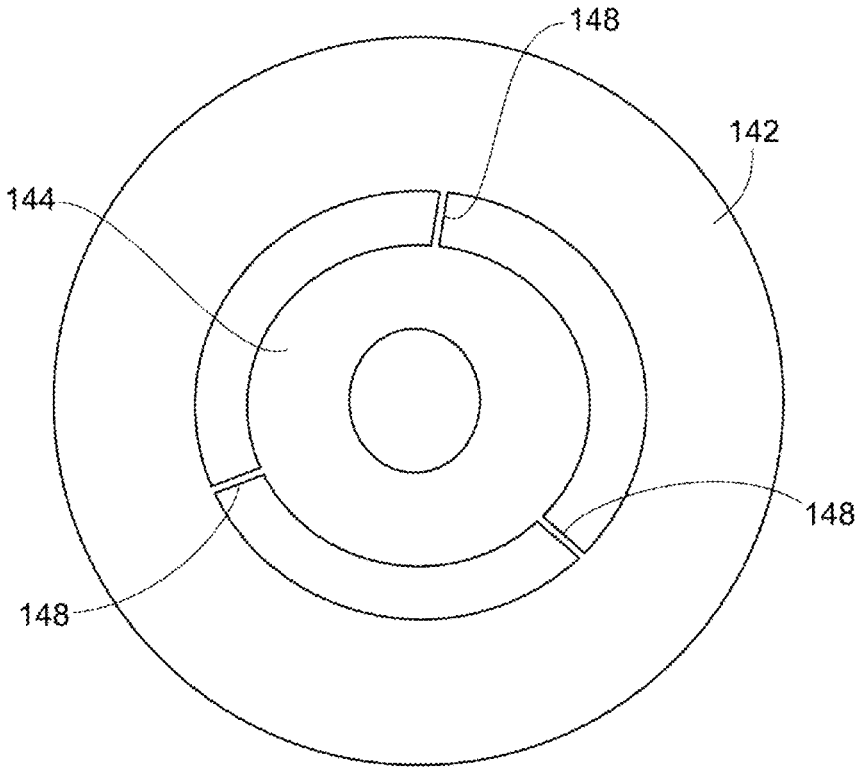
FIG. 3 illustrates an example of the first and second electrode surface rings.

The example tubular electrode 110 may be cast or machined substantially as a single piece, though the first electrode surface ring may be a separate ring of some type of precious metal or similarly suitable metal. It is also envisioned that the tubular electrode 110 can be made from powdered metal, wherein the powdered metal is sintered or injection molded. Other manufacturing techniques in which the powdered metal is melted rather than sintered are also envisioned. In some implementations, the first and second electrode surface rings 142, 144 are made from, for example, cylindrical or rectangular bar stock, which is cut to length and formed into a ring. In some implementations, the first and second electrode surface rings 142, 144 are made from flat sheet stock, and a punch is used to produce a number of electrode surface rings 142, 144 from a single flat sheet. FIG. 3 shows an example of the first and second electrode surface rings 142, 144 in which the two electrode surface rings are punched in a single operation such that the first and second electrode surface rings 142, 144 are attached via three tabs 148. In some implementations, both the first and second electrode surface rings 142, 144 are assembled to the tubular electrode 110 with tabs 148 in place to maintain the correct spacing between the electrode surface rings 142, 144. The tabs 148 are removed after the first electrode surface ring 142 is attached to the tubular electrode 110, and after the second electrode surface rings 144 is attached to the center electrode 102. The ring 142 may also be cut into one or more semi-circular sections to accommodate fabrication, assembly, attachment and/or thermal expansion.

Figure 4:
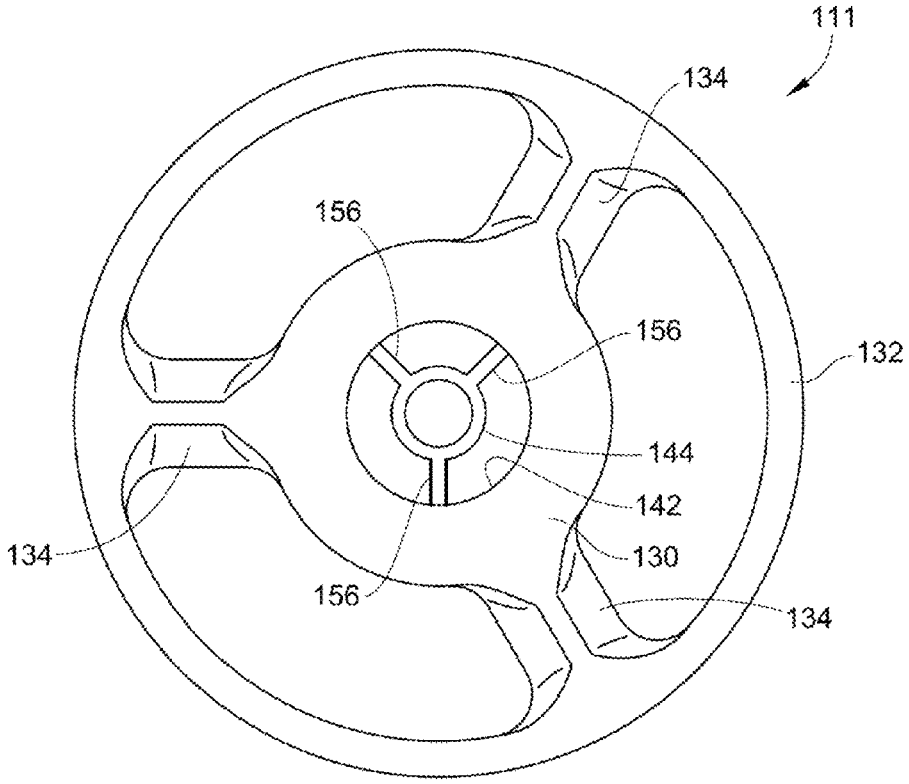
FIG. 4 is a plan view of the example tubular electrode.

Another example of the tubular electrode is illustrated in FIG. 4. In this example, the inner ring 130, outer ring 132, spokes 134 and velocity control tube 136 are substantially the same as for tubular electrode 110. However, tubular electrode 111 includes the second electrode surface ring 144 attached to the first electrode surface ring 142 by three tabs 156. As such, the correct spacing between the first and second electrode surface rings 142, 144 is maintained until assembly is completed. After assembly, the tabs 156 can be removed mechanically or by electron beam or water jet or similar method. However, in some implementations, the tabs 156 can be made, for example, from a material with a substantially lower melting point that the other materials in the tubular electrode 111 or the second electrode surface ring 144. This allows for the tabs 156 to be removed by burning or melting after assembly of the tubular electrode 111 to the pre-chamber spark plug 100.

There are several methods by which the first electrode surface ring 142 can be attached to the example tubular electrode 110. In some implementations, the tubular electrode 110 is cast around the first electrode surface ring 142. In some implementations, a separate metal ring with a layer of precious metal or similarly suitable metal attached to an inner surface of the metal ring is assembled to the inner ring 130 of the tubular electrode 110.

Figure 5:
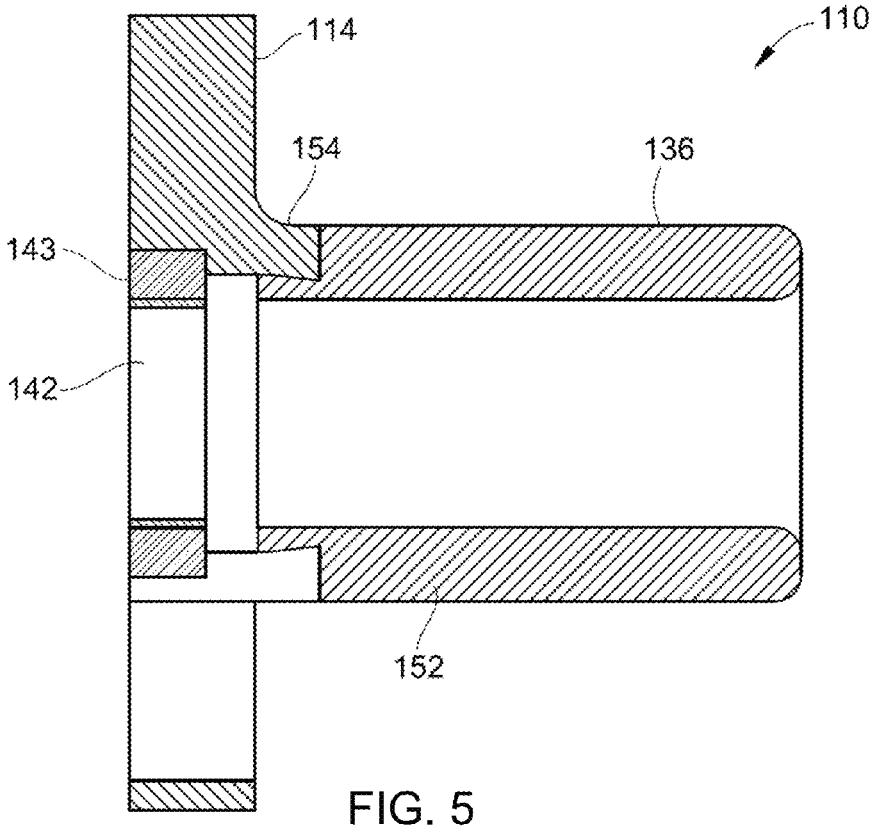
FIG. 5 is a cross-sectional view of the example tubular electrode having a first electrode surface ring on a substrate material.

For example, the electrode surface ring material can be deposited on a powdered metal substrate using physical or chemical vapor deposition. The powdered metal substrate may be a hollow cylinder and the electrode surface ring material can be deposited on the interior surface of the hollow cylinder. The cylinder could be sliced into a number of first electrode surface rings 142. If the same material is deposited on the outside of a smaller hollow cylinder, it could be sliced into a number of second electrode surface rings 144. Made in this fashion, the first electrode surface rings 142 could be inserted into the central opening of the tubular electrode 110 and welded or brazed in place. FIG. 5 shows a cross-sectional view of tubular electrode 110 having a first electrode surface ring 142 attached or deposited on a substrate material 143, for example a nickel alloy or highly conductive alloy. In some implementations, the weld is a tack weld in one spot or a few select spots to allow for some relative movement due to the differing rates of thermal expansion for the different materials. Using the methods described above to add the precious metal to the tubular electrode 110 allows for the fabrication of the pre-chamber spark plug 100 with less of the precious metal than typically used in conventional pre-chamber spark plugs, thus making the pre-chamber spark plug 100 less expensive to manufacture than many conventional pre-chamber spark plugs.

In some implementations, the example tubular electrode 110 can be assembled from separate components. FIG. 5 also shows a cross-sectional view of the tubular electrode 110 having a separate disk portion 114 and velocity control tube 136. In some implementations, the velocity control tube 136 has a notched portion 152 at one end, and the notched portion is press fit into an annular receiving portion 154 in the disk portion 114. In some implementations, the annular receiving portion 154 could be pressed inward into the notched portion 152 of the velocity control tube 136 holding it in place. In some implementations, the notched portion 152 includes an annular protrusion about its circumference that fits into a divot in the annular receiving portion 154 of the tubular electrode 110 to improve the attachment between the disk portion 114 and velocity control tube 136. In some implementations, the notched portion 152 is threaded along with an interior surface of the annular receiving portion 154 such that the velocity control tube 136 can be threaded into the disk portion 114.

Figure 7:
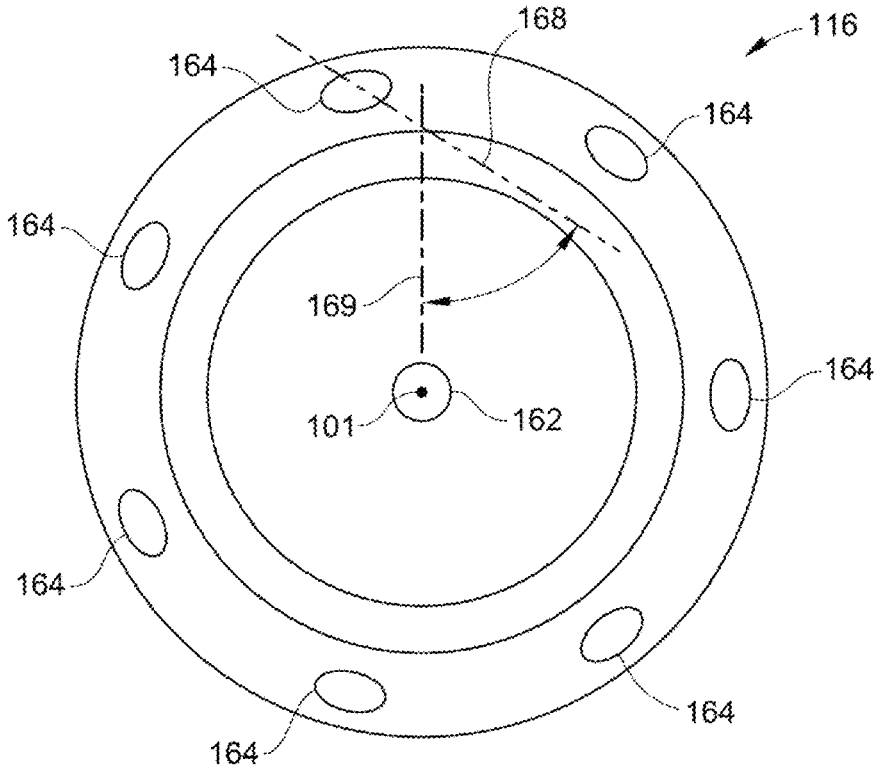
FIG. 7 is an end view of an example end cap for the pre-chamber spark plug.
Figure 8:
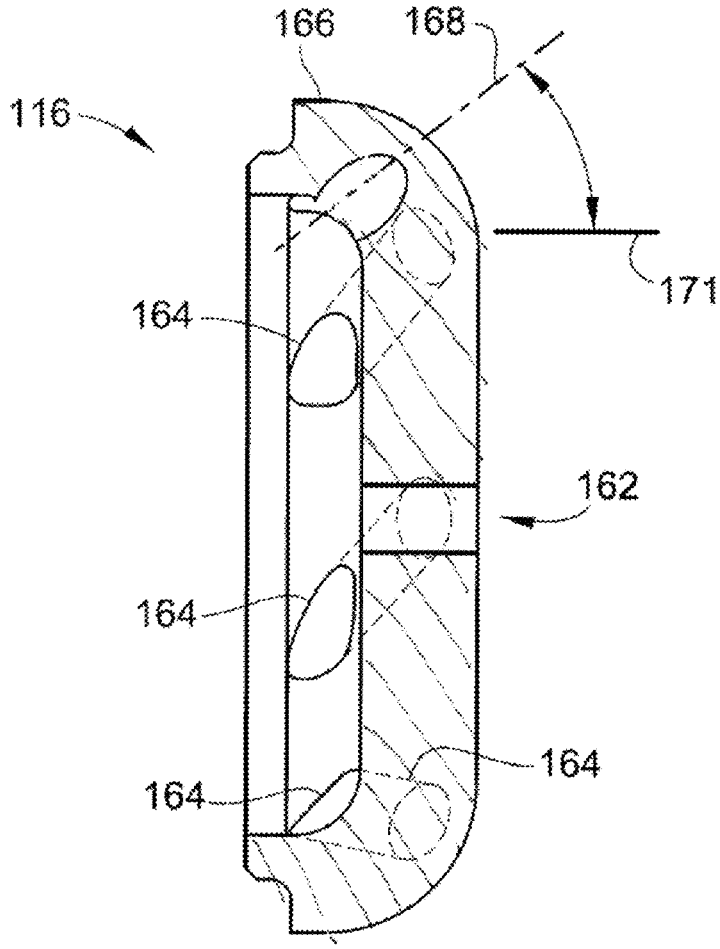
FIG. 8 is a cross-sectional view of the example end cap of FIG. 7.

Referring again to FIG. 1, in some example aspects of operation, the air/fuel mixture is drawn into the front chamber 108 of pre-chamber spark plug 100 from the main cylinder of the engine (not shown) through a center hole 162 (see also FIGS. 7 and 8) in end cap 116, and through a plurality of periphery holes 164 (see also FIGS. 7 and 8). The center hole 162 is oriented to direct its flow at and into the interior of the velocity control tube 136. Thus, the air/fuel mixture drawn in through the center hole 162 flows through the velocity control tube 136 to the spark gap between center electrode 102 and tubular electrode 110 where it is ignited by an electric spark. The velocity control tube 136 collects the flow from the center hole 162 and causes the flow in the interior of the tube 136 to stagnate and create a higher pressure than the pressure around the exterior of the tube 136 and the pressure at the exit of the tubular electrode 110. The velocity of the flow from the center hole 162 together with the pressure differential creates high velocity flow, guided by the velocity control tube 136, through the spark gap towards the back chamber 106. The velocity of the air/fuel mixture, in turn, causes the initial flame kernel to be transported into the back chamber 106.

In some example implementations, the flow through the primary central hole includes fresh air/fuel charge with a low level of residuals. This primary flow forces its way into the spark gap region, uniformly pushing the last combustion event residuals backwards and out of the spark gap region. This action effectively purges the spark gap of residuals, thus "controlling" the residuals within the pre-chamber. In conventional pre-chamber spark plugs, the residual gases are not "controlled" well or at all, leading to an unknown and uncontrolled mixture of fresh charge and left-over residuals at the time of spark. This represents a key source of shot-to-shot combustion variation within conventional pre-chamber spark plugs. Thus, the design implements a manner of residual gas control in that it effectively purges the residuals backwards (away from the end cap) and this control can, in certain instances, lead to exceptionally low coefficient of variation (COV).

In some examples, the periphery holes 164 are oriented to introduce a swirling motion to the air/fuel mixture drawn in through periphery holes 164. The swirling air/fuel mixture flows past the outside of the velocity control tube 136 toward the back chamber 106 where it is ignited by the flame kernel from the center hole flow. The turbulence caused by the swirling motion of the air/fuel mixture distributes the growing flame kernel around the back chamber 106 predominantly consuming the fuel in the back chamber 106. This results in a faster burn and a rapid increase in pressure inside the pre-chamber as combustion of the air/fuel mixture proceeds from the back chamber 106 to the front chamber 108. The result is a more complete burn of the air/fuel mixture and, therefore, increased pressure within the pre-chamber. This results in a high-velocity jet of flame through the center hole 162 and through the plurality of periphery holes 164 into the main combustion chamber (not shown).

In this manner, ignition can be delayed by the flow of the flame kernel to the back chamber 106. In some instances, the combustion process starts in the back chamber 106 and progresses through the front chamber 108 before the resultant flames project into the main combustion chamber. Because this increased ignition delay time results in a more complete burn, the process is more repeatable and has less variation, and therefore a lower COV, than in typical conventional pre-chamber spark plugs. An additional benefit of the delay in ignition is that the spark can be initiated sooner in the combustion cycle when the cylinder pressure is lower than would be the case without the ignition delay. Initiating the spark when the cylinder pressure is lower prolongs the life of the pre-chamber spark plug 100. The pre-chamber spark plug 100 is adapted to reach maximum enclosure pressure due to combustion of the air/fuel mixture in 7 or more crank angle degrees of the engine after a spark event in the spark gap.

Further, in configuring the example pre-chamber spark plug, the volume of the back chamber 106 behind the tubular electrode 110 and of the front chamber 108 in front of the tubular electrode 110 can be specified (e.g., improved or optimized in some instances) to control the flame kernel development and thus the ignition delay time. The ratio of volume of the front chamber 108 to that of the back chamber 106 controls the size and penetration of the flame jet that issues from the center hole 162.

Figure 6:
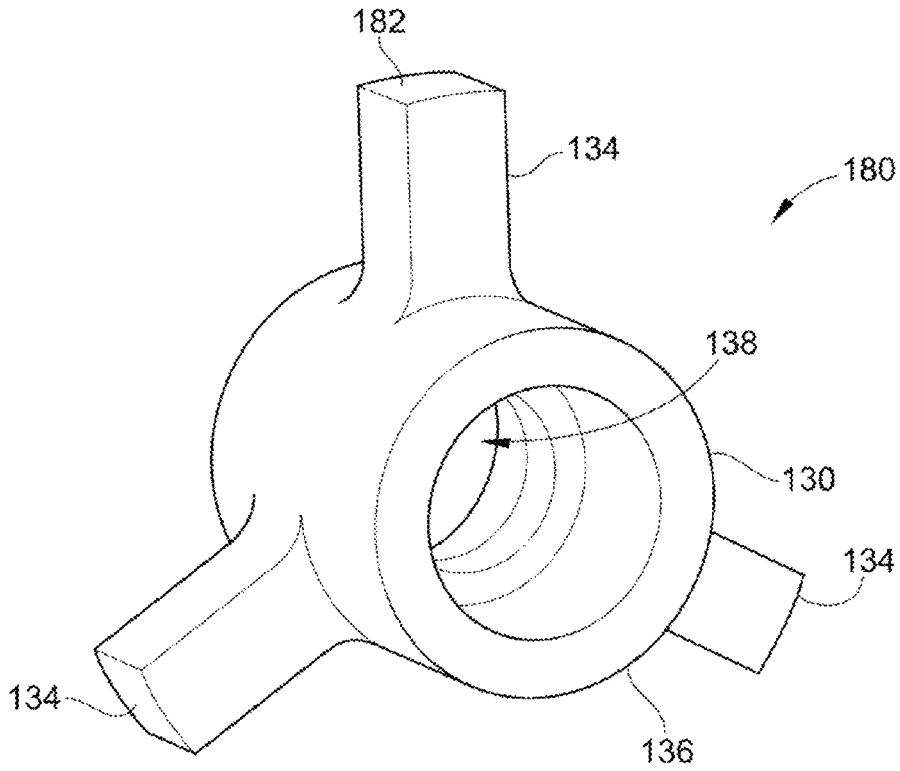
FIG. 6 is a perspective view of an example tubular electrode.

FIG. 6 is a perspective view of an example tubular electrode 180. Tubular electrode 180 serves as a ground electrode and is similar to tubular electrode 110, except that tubular electrode 180 has no outer ring. Tubular electrode 180 includes the inner ring 130 with a central opening 138. The inner ring 130 extends axially to form the velocity control tube 136. In FIG. 6, three spokes 134 extend radially outward from the exterior of the inner ring 130. In some implementations, the tubular electrode 180 is assembled to the pre-chamber spark plug 100 by attaching an end 182 of each spoke 134 directly to the shell 112. The attachment may be made by welding, brazing, or the like.

FIGS. 7 and 8 show an end view and a cross-sectional view, respectively, of the example end cap 116 for pre-chamber spark plug 100. In some implementations, the end cap 116 is cup-shaped such that it protrudes slightly from the end of the shell 112. The end cap 116 has center hole 162 that, in some implementations, is centered on the longitudinal axis 101 of the pre-chamber spark plug 100. The center hole 162 is configured to control the rate of flow of air/fuel mixture into the front chamber 108 and the velocity in the spark gap. The end cap 116 further includes the plurality of periphery holes 164 which may be drilled or formed in a sidewall 166 of the end cap 116 or the shell itself 112. The periphery holes 164 are configured to create a swirling motion of the air/fuel mixture in the pre-combustion chamber. In some implementations, the end cap 116 is attached to the shell 112 via welding, brazing, and the like. The end cap may also be flat (perpendicular to the shell) or "V" shaped. The shell 112 and end cap 116 may be shaped such that the end cap is 116 is flat and the majority of the insertion depth is due to the length of the shell 112. The shell 112 and end cap 116 may also be shaped such that the end cap 116 has a protruding shape (like a dome or "V" shape) and a portion of the insertion depth is due to the length of this end cap shape.

FIGS. 7 and 8 show the example end cap 116 having seven periphery holes 164 in the sidewall 166, and seven periphery hole axes 168. For the sake of simplicity, only one periphery hole axis 168 is shown in FIG. 7. FIG. 7 shows and end view of end cap 116 that includes an example swirl angle for the periphery holes 164, and further includes the longitudinal axis 101 for pre-chamber spark plug 100 as it would be located, in some instances, when the end cap 116 is assembled to shell 112. FIG. 8 is a cross-sectional view of the end cap 116 and shows an example penetration angle for the periphery holes 164. The central hole sizes are likely to range from 0.1 mm to 2.0 mm in diameter, but larger holes sizes may also be prescribed.

Other implementations of the example end cap 116 may have more or less than seven periphery holes 164. The periphery holes 164 are angled such that none of the periphery hole axes 168 intersect the longitudinal axis 101. As stated above, FIG. 7 illustrates a swirl angle for the periphery holes 164. As shown in FIG. 7, the swirl angle is defined as the angle between the periphery hole axis 168 and a radial line 169 projecting from the center of the end cap 116 through a point on the periphery hole axis 168 midway between the ends the cylinder defined by the corresponding periphery hole 164.

In the examples shown in FIGS. 7 and 8, the swirl angle is 45 degrees but, in other examples, the angle could be greater or lesser than 45 degrees. FIG. 8 illustrates a penetration angle for the periphery holes 164. As shown in FIG. 8, the penetration angle is defined as the angle between the periphery hole axis 168 and the longitudinal axis 101 or a line 171 parallel to the longitudinal axis 101. During engine operation, when an air-fuel mixture is introduced into the front chamber 108 of the pre-chamber, the angled nature of the periphery holes 164 produces a swirling effect on the air-fuel mixture in the pre-chamber. The exact location (i.e., on the sidewall 166) and configuration (e.g., diameter, angle) of the periphery holes 164 is dependent on the desired flow field and air-fuel distribution within the pre-combustion chamber.

Figure 9:
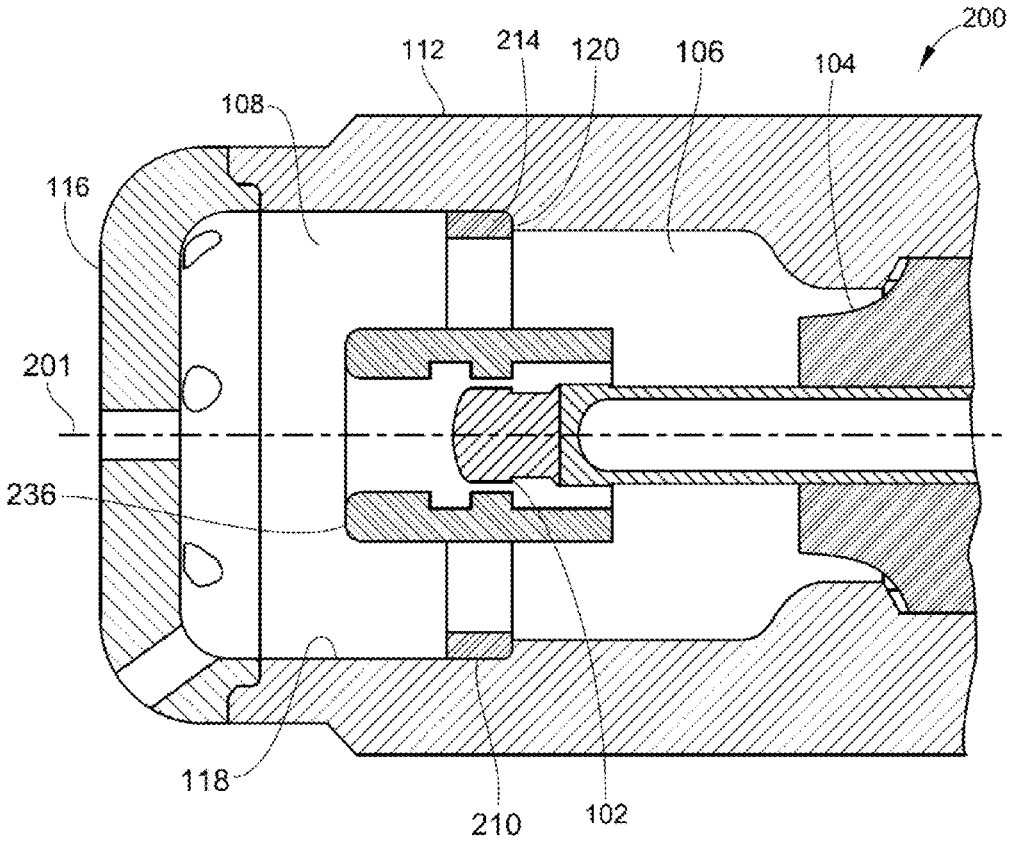
FIG. 9 is a cross-sectional view of a portion of an example pre-chamber spark plug.

FIG. 9 is a cross-sectional view of an example pre-chamber spark plug 200. Pre-chamber spark plug 200 has a longitudinal axis 201. The center electrode 102 that extends along the longitudinal axis 201, and further extends from the insulator 104 into the pre-chamber, divided into back chamber 106 and front chamber 108. A tubular electrode 210, disposed inside shell 112, serves as the ground electrode. The disk portion 214 of the tubular electrode 210 separates the back chamber 106 from the front chamber 108. The end cap 116 defines the end of the pre-chamber spark plug 200 and also a boundary of the front chamber 108. In some implementations, an interior surface 118 of the shell 112 may have a stepped portion 120 such that the tubular electrode 210 can seat on the stepped portion 120 during assembly of the pre-chamber spark plug 200. The ground electrode may also be constructed as a thin ring, which is suspended by legs attached anywhere on the shell including near the base where the core extends from the shell (112) or near the tip of the shell (108) or even attached from the end-cap itself (116). Any attachment method such as welding, brazing or laser welding or the like can be used to attach the tube.

In operation, the example pre-chamber spark plug 200 operates in a manner similar to that described above for the operation of example pre-chamber spark plug 100. However, it can be seen in FIG. 9 that a tubular inner ring, or velocity control tube 236 extends axially both into the front chamber 108 and into the back chamber 106. By increasing the length of the velocity control tube 236, i.e., adding the portion that extends into the back chamber 106, the ignition delay time can be further increased. In this case, the ignition delay time is controlled by the length of the extended back portion of the velocity control tube 236, and by the flow velocity in the extended back portion of the velocity control tube 236. The flow velocity in the velocity control tube 236 is a function of the mass flow through the center port 162. The increased ignition delay time that results from the extended velocity control tube 236 allows the spark to be initiated even earlier than in the case of pre-chamber spark plug 100. Initiating the spark earlier when cylinder pressure is lower prolongs the life of the spark plug. Such a design also makes it possible to fabricate pre-chamber spark plugs having center and ground electrodes without any precious metal. This reduces the material cost and simplifies substantially the manufacture and assembly of the spark plug. But the design can also accommodate the insertion of a precious or non-precious metal ring inside the ground electrode which is in electrical contact with the ground electrode body and thus in contact with the shell. The ring insert may be mounted via press-fit, interference fit, laser tack weld, laser weld or brazing. The design holds the ring insert in place even if the welds are to soften or break simply due to differential thermal expansion of the unconstrained section of the ground electrode tube relative to the section constrained by the spokes.

Figure 10:
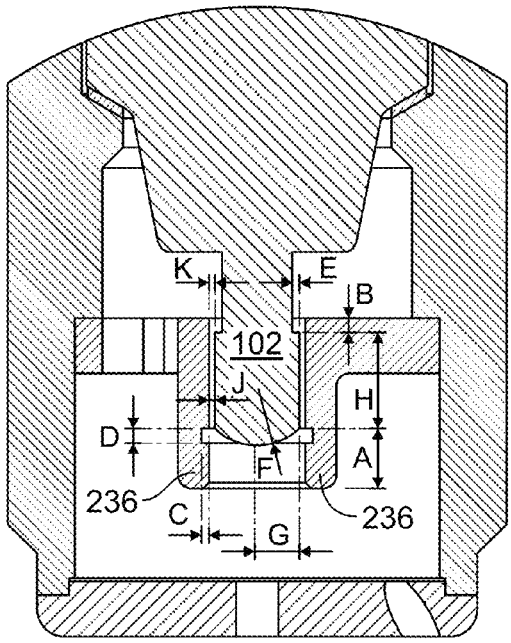
FIG. 10 is a cross-section view of an example pre-chamber pre-chamber spark plug assembly with dimensions labeled.

FIG. 10 shows a cross section view of an example pre-chamber spark plug assembly similar to that of FIG. 9. Certain relevant dimensions in FIG. 10 are labeled as A-K. The dimensions are relevant to pre-chamber spark plug an M14 to M24 sized plug (i.e., a spark plug where the threaded portion of the shell is a metric M14 to M24 thread). Thus, for example, the outer diameter of the shell is slightly smaller than a root diameter of the thread. Accordingly, the total volume of the back chamber 106 and the front chamber 108 can range between 1000 $mm^3$ and 3000 $mm^3$ In the example shown, dimension A is the length the ground electrode 210 extends past the spark surface of center electrode 102, forming part of a passage. In certain instances, dimension A has a minimum length of 1.0 mm. The extended ground electrode 210 creates the velocity control tube 236, and thus dimension A can characterize the length of the velocity control tube 236. The velocity control tube 236 creates a stagnation pressure zone which enables air/fuel mixture flow to sweep the flame kernel into the rear pre-chamber 106. In certain instances, the clearance between the end of the center electrode 102 and the end cap 116 can range between 1 mm and 12 mm. Dimension B is an extension of the ground electrode 210 away from the combustion chamber end of the spark plug enclosure. The extension along with the spark gap forms part of a passage. In certain instances, dimension B has a length of at least 0.1 mm.

In the example shown, dimensions C and D define the cross-sectional area of an inlet tube notch in the velocity control tube 236. In certain instances, dimension C, the depth of the notch, has a range of 0.10 to 0.70 mm. In certain instances, dimension D, the length of the notch, has a range of 0.1 to 4.0 mm. The inlet tube notch minimizes flame kernel quenching effects under low speed operation and cold start. Dimension E defines the depth of a flame holder notch in the center electrode 102. In certain instances, dimension E has a range of 0.10 to 0.70 mm. The flame holder notch allows greater recirculation and also reduces quenching effects as a flame kernel travels to the rear pre-chamber 106.

The example center electrode 102 can have a rounded front defined by dimensions F and G. In the example shown, dimension F is the radius of curvature of the rounded tip of the center electrode 102. A rounded tip enables more symmetric flow into the spark gap and reduces flow resistance. A flat tip with no curvature is easier to manufacture, and can be used in the implementations described herein, but permits greater flow turbulence and can reduce flow velocity. Thus, a curved tip may be used in some instances. The diameter of the center electrode 102 is defined by dimension G. In certain instances, dimension G has a length of 3 mm. In certain instances, a range of lengths of dimension F can be selected to satisfy the relation $G/F \leq 1$.

In the example shown, the length of the spark gap surface is defined by dimension H. In certain instances, dimension H has a range between 2.50 to 6.00 mm. In the example shown, the spark gap is the distance between the center electrode 102 and the ground electrode 236 and is designated by dimension J. In some cases, the spark gap distance is not a single value along the length of the spark gap surface. The ground electrode 236 can have a conical profile defined by taper angle K. In certain instances, taper angle K can have a range between 0.10 and 2.5 degrees. In the example shown, the minimum spark gap distance is at the front of the ground electrode 236, and the maximum spark gap distance is at the rear of the ground electrode 236.

In some example, during cold start, the spark will occur in the region near the minimum gap at the front of the spark surface. In certain instances, when cold, dimension J can have a minimum in the range 0.10 to 0.20 mm. When the spark plug has entered nominal warm operation, the front of the spark gap surface will be warmer than the rear of the spark gap surface. Greater thermal expansion of the front of the spark gap surface can cause the spark gap distance to become more uniform and parallel along the length of the spark surface. The spark gap dimension J during nominal warm operation can have a length of 0.42 mm. A spark gap with parallel surfaces can spark along its entire length and increase flame kernel generation.

Figure 11A:
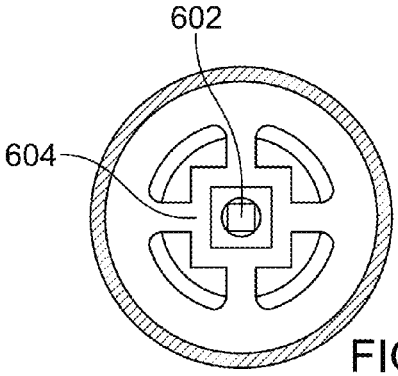
FIGS. 11*a* and 11*b* show example pre-chamber spark plug assemblies with square and triangular electrodes.
Figure 11B:
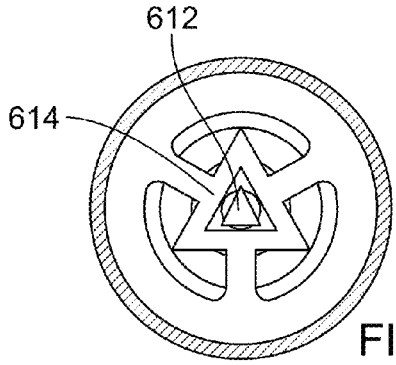

The ground electrode and center electrode can each have a cylindrical shape, a polygonal shape, an irregular shape, or some other shape. For example, FIG. 10 shows a cross-section with a cylindrical center electrode 102 and a cylindrical ground electrode 236. The center electrode and ground electrode may be polygonal, such as the example square and triangular shapes shown in FIGS. 11*a* and 1*b*. The velocity control tube on the front of the electrodes can have a shape similar to that of the electrodes (e.g., a triangular shape for FIG. 11*b*) or have a shape different to that of the electrodes. The electrodes also may have an irregular shape or parts of an electrode may have a different shape. For example, the inner perimeter of an electrode may have a different shape than the outer perimeter of the same electrode. The electrodes can also have a variable shape along their axial length. The electrodes can taper, have step changes, or have other changes in dimension. The center electrode and ground electrode also need not be the same shape. For example, the spark surface of the center electrode and corresponding surface of the ground electrode may match, and the portion ahead of the center electrode (i.e., the velocity control tube) may have a different shape.

Figure 12:
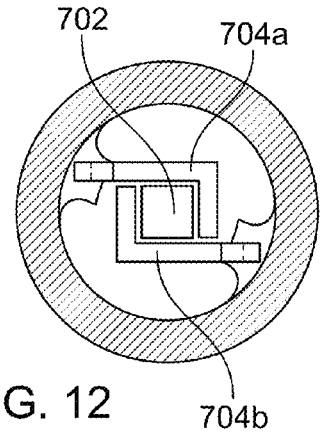
FIG. 12 shows an example spark plug assembly with multiple ground electrodes.

The electrodes can also have different shapes or include different or multiple parts, positions, locations, or spark surfaces. For example, FIG. 12 shows an example spark plug assembly with multiple ground electrodes 704*a*, 704*b* surrounding a single center electrode 702. The example ground electrodes 704*a*, 704*b* are adjacent but do not meet. The multiple ground electrodes 704*a*, 704*b* define the flow passage through the spark gap. The ground electrodes 704*a*, 704*b* can have forward extending wall portions that, together, form a velocity control tube ahead of the spark gap. The electrodes 704*a*, 704*b* can also have rearward extending extensions. In other instances, a velocity control tube can be attached to the forward or rearward facing surfaces of the ground electrodes 704*a*, 704*b*.

Figure 13:
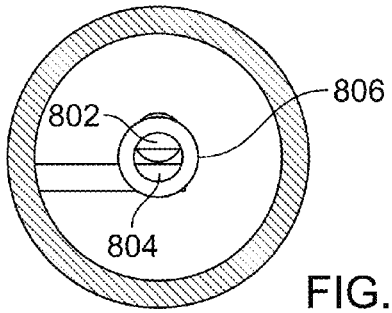
FIG. 13 shows an example spark plug assembly with a velocity control tube centered over the spark gap.

FIG. 13 shows a front cross-section of an example spark plug assembly. In this example, the velocity control tube 806 is a cylinder centered on the spark gap between the center electrode 802 and a J-shaped ground electrode 804. The example velocity control tube 806 can be attached to the ground electrode 804 or the center electrode 802. In certain instances, the tube 806 can have portions that extend downward over the sides of the gap. The velocity control tube can be cylindrical, polygonal, or some other shape. The velocity control tube need not be centered over the center electrode.

Figure 14:
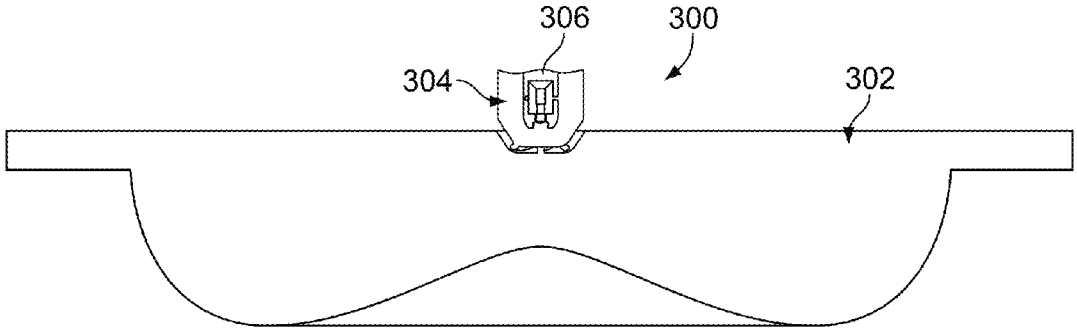
FIG. 14 is a cross-sectional view of an example large bore piston cylinder assembly and an example pre-chamber spark plug.

FIG. 14 illustrates a cross-sectional view of an example pre-chamber spark plug assembly 300. The pre-chamber spark plug assembly 300 includes a pre-chamber 304 in the head of large bore piston cylinder chamber 302. Within the pre-chamber 304, is a spark plug 306 adapted for the configuration of having the pre-chamber 304 in the head of a large bore piston cylinder 302.

Figure 15:
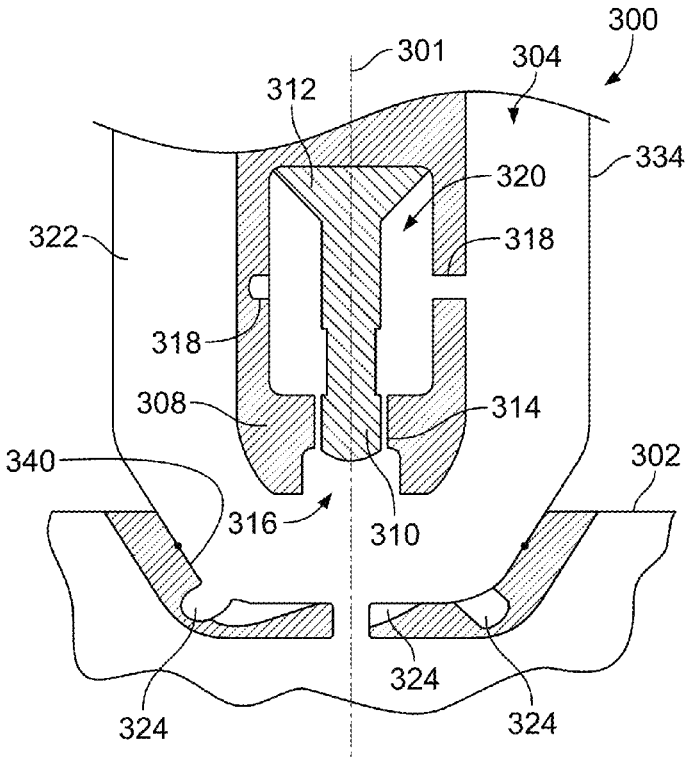
FIG. 15 is a cross-sectional view of another example pre-chamber spark plug.

FIG. 15 illustrates a close up cross-sectional view of the pre-chamber 304 of the example pre-chamber spark plug assembly 300 of FIG. 14. The pre-chamber 304 is connected to the engine combustion chamber 302 by a series of ventilation holes 324 and bounded by a shell 334. The ventilation holes 324 allow a fuel and air mixture to enter the pre-chamber 304, and for a flame to exit the pre-chamber 304 into the cylinder assembly 302. While FIG. 15 shows three ventilation holes, more or less are contemplated. Additionally, the ventilation holes 324 (or any of the holes herein) could be in the form of slots or other shaped holes.

The example pre-chamber 304 has a longitudinal axis 301 and a center electrode 310 that extends axially along the longitudinal axis 301 into a pre-combustion chamber 304. Around the center electrode, at the center electrode's 310 distil end, is the ground electrode 308. The ground electrode 308 is attached to the insulator 312, which insulates the center electrode 310 from the ground electrode 308. In certain instances, the center electrode 310 connects to a voltage source (not shown), through the interior of the insulator 312, to the shell 334, which is electrically grounded.

The ground electrode 308 forms a circular region around the distil end of the center electrode 310 forming spark gap 314. Further, the spark gap 314 is between the outer surface of the center electrode 310 and a tubular inner ring of the of the ground electrode 308 that is spaced in surrounding relation to the center electrode 310. The insulator 312 extends axially around the center electrode 310 from above the spark gap 314 up to the top of the pre-chamber 304. The insulator 312 acts as the velocity control tube. Additionally, above the spark gap 314 are two lateral slots or holes 318 drilled into the insulator 312. The lateral holes 318 act to ventilate a flame kernel after an ignition event.

In some instances, the area around the center electrode 310 and inside the insulator 312 is referred to as a first stage 320 of the pre-chamber 304. The first stage 320 can act to restrict fuel into a small space such that a flame kernel generated by an ignition event is protected and controlled as to not cause excessive damage to the ground electrode 308 and the center electrode 310. While two lateral holes 318 are shown in the insulator 312, a greater or smaller number of lateral holes may be used.

In some instances, the area outside of the insulator 312 and bounded by the shell 334 is referred to as a second stage 322 of the pre-chamber 304. In the example shown, the second stage 322 is where the flame kernel begins to expand prior to exiting from the ventilation holes 324 into the engine combustion chamber 302 (i.e., cylinder).

Additionally, the example ground electrode 308 extends further into the pre-chamber 304 than the center electrode 310. As illustrated in FIG. 15, the example ground electrode 308 includes a radial offset circumferential extension extending axially past the distil end of the center electrode 310 forming an aerodynamic nose cone. The shape of the aerodynamic nose cone is configured to facilitate a flow of an air/fuel mixture through spaces between the ground electrode 308 and the center electrode 310. The nose cone is aerodynamic in that it is designed to smoothly guide flow (and minimize separation of flow) around the leading edge of the ground electrode 308. In other instances, the nose of ground electrode 308 could be blunt. The extension creates an aerodynamic ram region 316 (i.e., velocity control tube). The aerodynamic ram region 316 functions to trap the vapor flow from the main cylinder chamber 302 as it flows into the pre-chamber 304. This trapped vapor is an air/fuel mixture that is ignited at the spark gap 314. The vapor through the spark gap 314 flows parallel to the spark gap 314 and can have a velocity range of 5 msec or greater, and in some instances 50 m/s. For a spark gap with height H and flow velocity through the gap V, then the relation H/V*360*RPM can be less than or equal to 3 crank angle degrees of the engine.

As an aside, the spark gap 314 width can be altered to affect useable life of the spark plug, in some instances. For example, increasing the axial length of the spark gap increases the surface area of where a spark is generated. Therefore, it will take longer for the material that composes the center electrode 310 and the ground electrode 308 to erode to the point that the plug itself needs to be refurbished or replaced. The drawback to increasing the width is that this shrinks the first stage and thereby makes initial ignition of the fuel more difficult.

Figure 16:
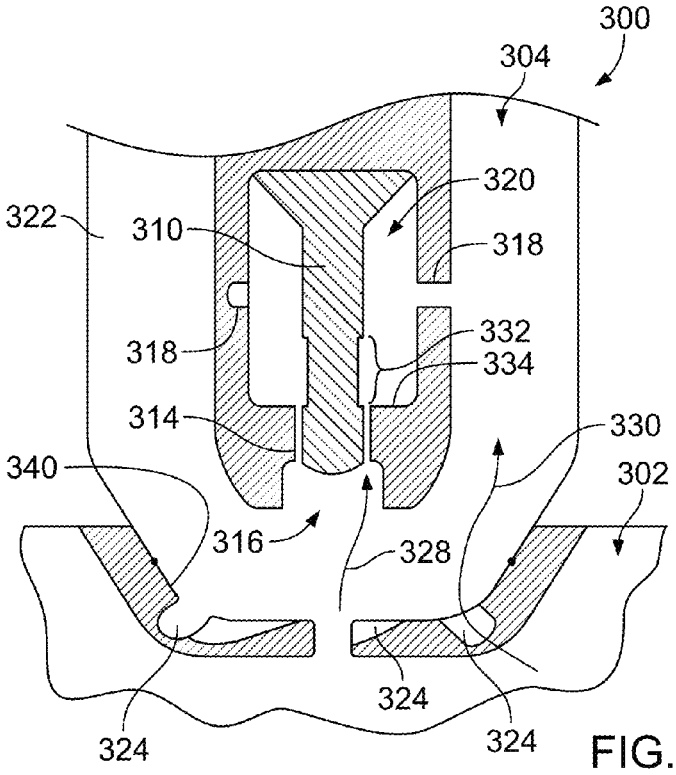
FIG. 16 is a cross-section view of the example pre-chamber spark plug of FIG. 15 illustrating fuel flow into the pre-chamber.

FIG. 16 illustrates the flow physics of an example of how combustion is created and managed in the example pre-chamber 304. Initially, a mixture of fuel and air will flow into the pre-chamber through the ventilation holes 324 from the cylinder assembly 302. The flow is created because of a pressure differential between the engine combustion chamber 302 and the pre-chamber 304 created during the compression stroke of an associated engine system (not shown). The flow is composed of a primary and secondary flow 328 and 330 respectively. As the primary and secondary flow 328, 300 enter the pre-chamber 304, the primary and secondary flow 328, 300 purge residual fuel from previous ignition cycles from the spark gap 314 and the second stage 322 with fresh evenly dispersed fuel. The secondary flow disperses uniformly around the second stage 322 of the pre-chamber 304. The primary flow 328 is captured by the aerodynamic ram region 316. The aerodynamic ram region 316 gathers the primary flow around the spark gap 314. The velocity of the primary flow 328 into the spark gap 314 is between 1 and 100 meters per second. The fuel that is part of the primary flow 328 will gather around the spark gap 314 thus creating a pressure differential between the area within the aerodynamic ram region 316 and the first stage 320, thereby causing the fuel to flow into the first stage 320 of the pre-chamber 304. The flow into the spark gap 314 also purges the spark gap 314 of residuals, replacing any residuals with a predominantly fresh charge. In certain embodiments, a distal end of the center electrode 310 is flat to facilitate the primary flow 328 into the spark gap 314.

Additionally, in some instances, fuel will flow through the lateral holes 318. This flow is predominantly backward and away from the end cap. The lateral holes 318 are angularly offset such that they are not perpendicular to the center axis 301. This can prevent the air/fuel mixture from the secondary flow 330 from filling the first stage 320. Therefore, the pressure differential caused by aerodynamic ram region 316 is not disturbed by the lateral holes 318. The flow through the lateral holes 318 retains a measure of its entrance velocity. This maintains a pressure lower than the stagnation pressure of the fluid in the aerodynamic ram region 316. Thus, a pressure difference is created across the spark gap.

Once a spark is generated in the example spark gap 314, the fuel in the spark gap 314 will ignite thus creating a flame kernel 332. Because of the pressure differential, the flame kernel 332 travels into the first stage 320 of the pre-chamber 304 where the flame kernel 332 is protected from the outside environment by the relatively small size of the first stage 320. The first stage 320 acts as a flame holder. The flame kernel moves upward into a notch 332 located in the center electrode 310. The notch 332 then introduces the flame kernel to a backwards facing step structure 334 of the ground electrode 308. As the primary flow enters the first stage 320 the backward facing step creates a recirculation zone trapping some fuel in this location that allows the flame kernel to expand slightly while also being protected from being quenched by primary flow entering the spark gap 314. Therefore, the notch 332 and the backwards facing step 334 form a flame holder that protects the flame kernel from the higher velocity primary flow 328.

Additionally, because the lateral holes 318 allow only a minimal amount of the fuel to enter the first stage 320, the flame kernel 332 remains small. This keeps the temperature inside the first stage 320 low and minimizes damage to the spark gap 314, the ground electrode 308, and the center electrode 310.

In the example shown, as the flame kernel 332 consumes the fuel in the first stage 320 it travels out of the lateral holes 318 into the second stage 322 of the pre-chamber 304. The flame kernel 332 is carried by the secondary flow 330 and wraps around the insulator 312. At this point the flame kernel 332 begins to spread and consume the fuel in the second stage 322. The flame then expands, greatly increasing the pressure inside the pre-chamber 304, and jets out of the ventilation holes 324 into the engine combustion chamber 302 where it ignites the fuel in the engine combustion chamber 302.

Controlling the flow of the flame kernel 332 around the center electrode 310 can increase the usable lifetime of the pre-chamber spark plug assembly 300. This is because the first stage surrounds the center electrode 310 and only allows the small flame kernel 332 to burn around it, as opposed to some traditional systems that have an exposed spark gap with no protection.

Figure 17:
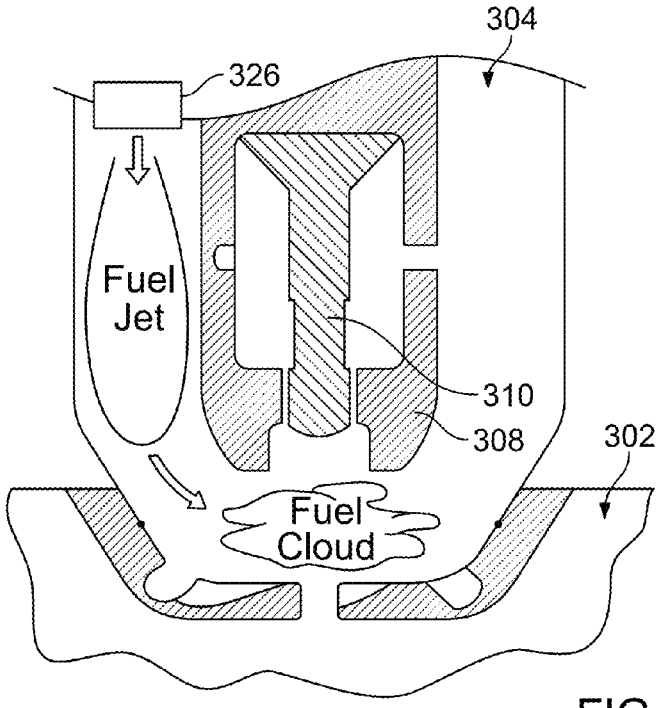
FIG. 17 is a cross-sectional view of an example pre-chamber spark plug having a secondary fuel injector in the pre-chamber.

FIG. 17 illustrates an example secondary fuel injector 326 in the pre-chamber 304. The example secondary fuel injection 326 injects fuel into the pre-chamber 304. Another primary fuel injector (not shown) injects fuel into the main cylinder chamber 302, which travels into the pre-chamber 304 through the ventilation holes 324. The secondary fuel injector 326 allows the user to enrich the pre-chamber mixture beyond what would typically be present from the primary injection.

Typically, the fuel to air ratio of the example cylinder chamber 302 is stoichiometric, or in other words the fuel and air exist in equal quantities in the cylinder chamber 302 prior to combustion. Therefore, the fuel to air ratio within the pre-chamber 304 could be stoichiometric or less than that (leaner) due to the flow through ventilation holes 324. To provide a properly fuel enriched environment in the pre-chamber 304 employing the secondary fuel injector 326, the secondary fuel injector 326 increases the fuel to air ratio. Typically the increase will be such as to make the lean mixture coming from the main combustion chamber stoichiometric, or in other words it would not be atypical to enrich the pre-chamber fuel as air is present in the pre-chamber 304 prior to combustion to more than twice the main chamber fuel-air ratio. By enriching the pre-chamber 304, the ignition process can run hotter. However, running the ignition process hotter can decrease the useable lifetime of the center and ground electrodes 310, 308. This example can enable the fuel-fed (fuel-enriched) pre-chamber to run leaner with minimal or no enrichment—thus creating a fuel-air ratio in the pre-chamber to be much closer to the lean mixture found in the main chamber and as far away from stoichiometric enrichment as possible. Such reduction in pre-chamber enrichment leads to lower combustion temperatures in and around the spark surfaces, which leads to extended life of the spark plug.

Figure 18:
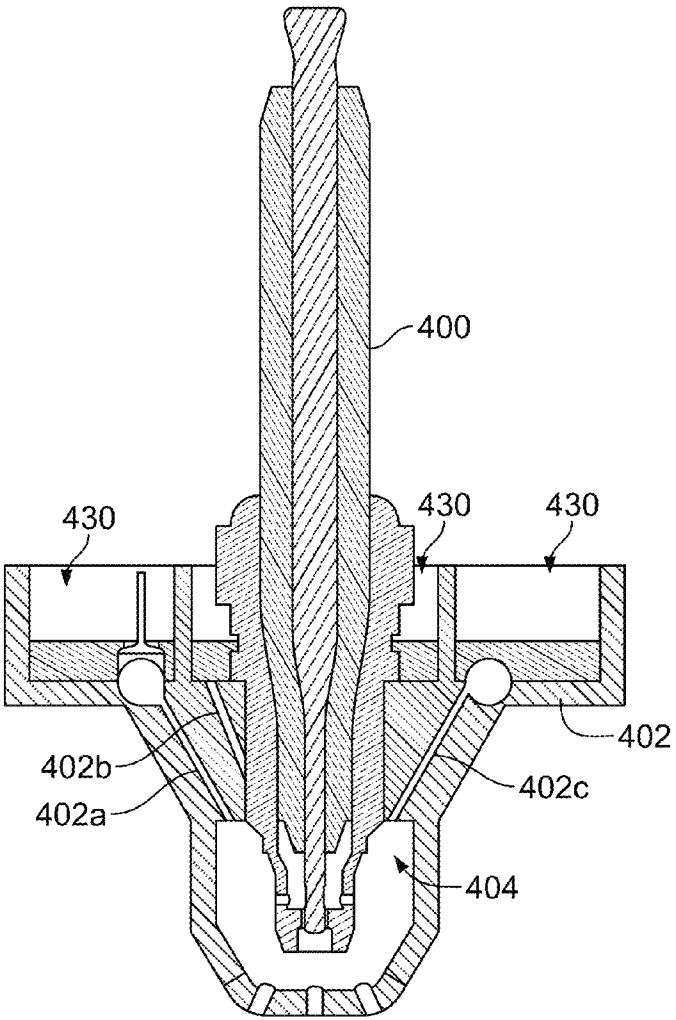
FIG. 18 is a cross-sectional view of an example combined gas admission valve with igniter/spark plug.

FIG. 18 illustrates a gas admission valve 402, integrally formed with a shell 416 of a pre-chamber 404, combined with a spark plug 400. In the particular embodiment illustrated in FIG. 18, there are three separate gas admission valves 402*a*, 402*b*, and 402*c*. The gas admission valves 402*a*, 402*b*, and 402*c* supply fuel from storage chambers 430 to the pre-chamber 404. As discussed in regard to FIG. 17, the gas admission valve 402 allows the user to adjust the richness of the fuel/air mixture in the pre-chamber 404. Further, in certain embodiments, the spark plug 400, which includes an insulator 414, a center electrode 406, and a ground electrode 408, is removable from the gas admission valve 402 portion such that quick replacement of the spark plug 400 is facilitated.

Figure 19:
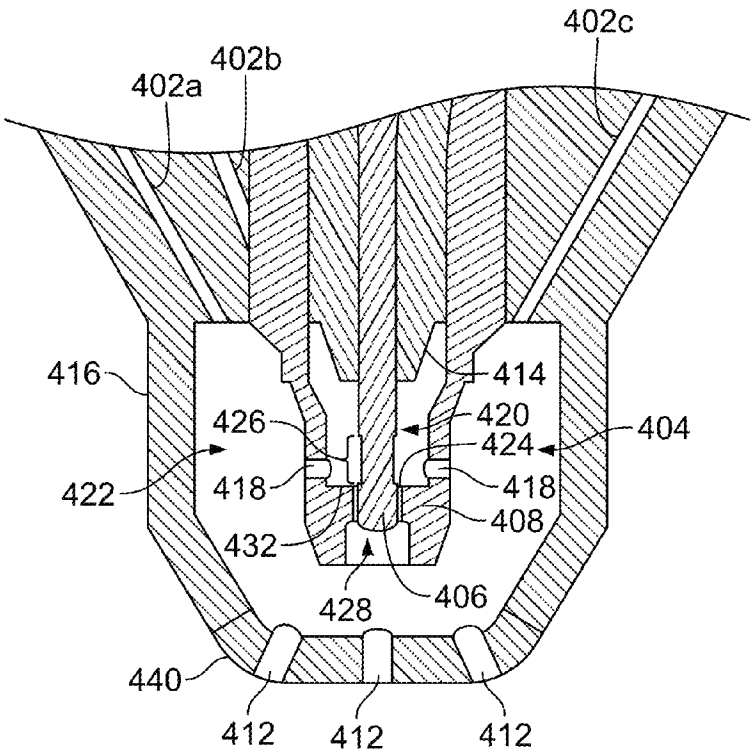
FIG. 19 is a close up cross-sectional view of the example igniter/spark plug of FIG. 18.

FIG. 19 illustrates a close-up view of the pre-chamber 404 of FIG. 18. The pre-chamber 404 is connected to a cylinder of an engine (not shown) system by and end cap 440 with ventilation holes 412. Similar to implementations discussed above, the pre-chamber 404 includes a center electrode 406, a ground electrode 408, ventilation holes 412, an insulator 414, and a shell 416. An aerodynamic ram 428 also exists in this embodiment. Further, the insulator includes lateral holes or slots 418. Similar to the later holes 318 (from FIG. 15), the slots 418 provide access from a first stage 420 that is defined by a cavity formed between the ground electrode 408 connected to the insulator 414 and the center electrode 406, and a second stage 422 that is defined by a cavity between the shell 416 and the ground electrode 408 attached to the insulator 414.

In some examples, a first pressure differential is created by the compression stroke of an engine system forcing a fuel/air mixture into the pre-chamber 404 through the ventilation holes 412 at a velocity between one and one-hundred meters per second and directed backwards and away from the end cap. As this mixture flows into the pre-chamber 404, it will gather around a spark gap 424 formed between the center electrode 406 and the ground electrode 408. The relative small width of the spark gap 424 will facilitate a second pressure differential between the first stage 420 and the second stage 422 of the pre-chamber 404. Therefore, when a spark is generated at the spark gap 424, the second pressure differential will draw the flame kernel formed by the spark igniting the fuel/air mixture into the first stage 420, which has an area expansion which serves to slow the flow and create a recirculation zone. The area expansion is created by a notch cut into the center electrode at the exit of the spark surface area. The recirculation zone can hold reactive particles in the recirculation loops and acts effectively as a flame holder—preventing the blow-out of the flame kernel which is swept out of the spark gap region. This flame kernel will burn the fuel in the first stage until it exits through the slots 418 into the second stage 422. In the second stage, the flame kernel grows into a flame by consuming the fuel in the pre-chamber 404. This greatly increases the pressure in the pre-chamber 404 and causes the flame to jet from the ventilation holes 412.

Removal of the flame kernel from the spark gap region and into the flame holder can reduce the temperature of the spark surfaces. Reducing the temperature of the spark surfaces can reduce a primary factor in spark plug loss of life: high temperature oxidation of the spark surface in the presence of high temperature oxidizing environment. Thus the removal of the high temperature flame kernel from the spark gap after the spark has occurred can extend the spark surface and thus the spark plug life, reducing the likelihood (or preventing) flame kernel quenching.

In some instances, another function of the central or primary hole flow is to cool the tubular ground electrode and the spark area during the induction period prior to spark, since the inducted fresh charge is of a lower temperature than the residual gases in the pre-chamber. This further extends spark plug surface life but also reduced the surface temperatures in the pre-chamber, keeping temperatures below the auto-ignition temperature of the fresh charge.

Similar to the previously described example, by controlling the flow of the flame kernel around the center electrode 406, the usable lifetime of the example spark plug 400 can be greatly increased. This is because the first stage surrounds the center electrode 406 and only allows the small flame kernel to burn around it, as opposed to some traditional systems that have an exposed spark gap with no protection.

Figure 20:
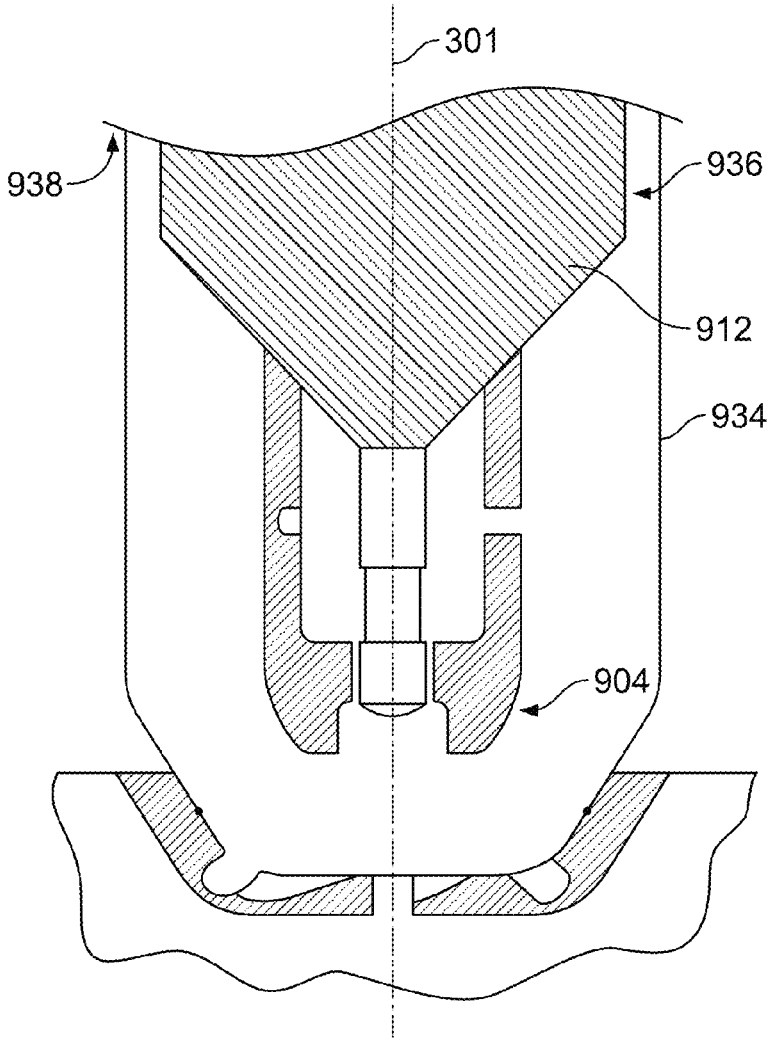
FIG. 20 is a close up cross-sectional view of a crevice of a pre-chamber.

In another example, a crevice 936 is created between an exterior surface of a ceramic insulator 912 and an interior surface of a shell 934 near a base or root 938 of the shell 934 and insulator 912, as illustrated in FIG. 20. The crevice 936 is designed to enhance heat transfer from the hot residual fuel/gases to the cooler shell region, which is cooled on the back side by engagement with the threads of the cylinder (not illustrated) head (presumably water or oil cooled). The crevice 936 has a large surface area to volume ratio, which promotes cooling of the residual has and thus "quenching" of the residual gas reactivity.

In one embodiment, the crevice 936 volume is designed to be approximately ⅕ to 1/10 of the pre-chamber 904 volume, such that if the pre-chamber 904 is full of residual gases, these will be compressed into the crevice 936 taking up nor more space than that allowed by the compression ratio of the engine. (i.e., a 10:1 CR engine will reduce the pre-chamber gas volume to 1/10 during compression).

A further embodiment may include surface area enhancement of the crevice region by a means similar to "threading" the shell 934 in the crevice 936 to further enhance the heat removal capability of the crevice 936 to cool the residual gas.

Figure 21:
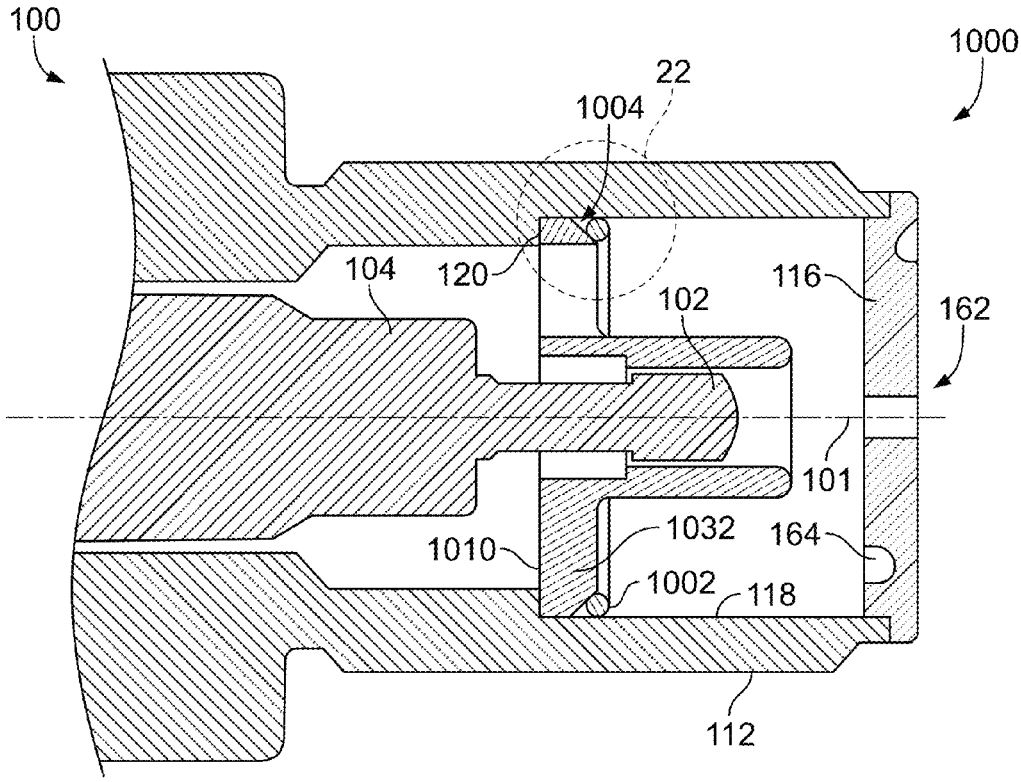
FIG. 21 is a cross-sectional view of a portion of an example pre-chamber spark plug including a braze ring.
Figure 22:
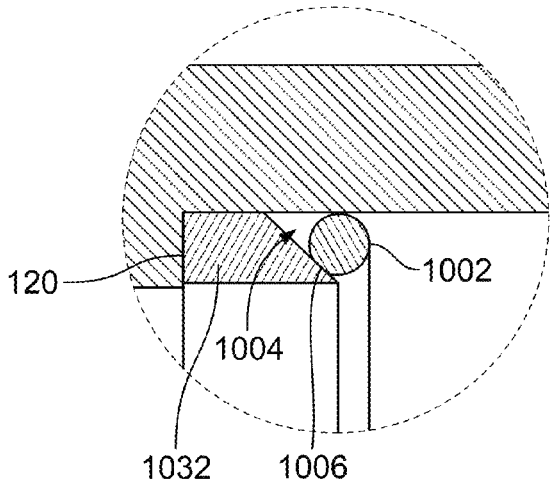
FIG. 22 is an up-close view of the example braze ring disposed inside the pre-chamber spark plug of FIG. 21.

Regarding manufacturing methods, a braze ring may be used above or below the ground electrode and melted to give good heat transfer in a braze oven. Similarly, a laser welder, friction welder, or the like can be used to weld the ground electrode to the shell FIG. 21 is a cross-sectional view of a portion of an example pre-chamber spark plug including a braze ring, and FIG. 22 is an up-close view of the braze ring disposed inside the pre-chamber spark plug, from FIG. 21. The outer ring 1032 of the ground electrode 1010 includes an angular cut out 1006, which creates the annular gap 1004 for the braze ring 1002 to sit in prior to laser welding. In the example shown in FIG. 21, during assembly, the ground electrode 1010 is pressed into the shell 112 such that the ground electrode 1010 seats onto the stepped portion 120. After seating the ground electrode 1010 onto the stepped portion 120, the braze ring 1002 is placed into the annular gap 1004. Once the braze ring 1002 is seated into the annular gap 1004, a laser welder may be utilized to melt the braze ring 1002 thereby allowing the melted braze ring 1002 to flow into the annular gap 1004 adhering the ground electrode 1010 to the shell 112 in a braze-welding process. This can create a strong bond between the ground electrode 1010 and the shell 112 such that no heat distortion is created between the two bodies once bonded together. Also, only the braze ring 1002 is melted such that the ground electrode 1010 and the shell 112 do not have a distorted shape after the braze-welding process. Further, the angular cut out 1006 does not have to be angular. Rather the cut out portion of the ground electrode 1010 may be any shape suitable for holding the braze ring 1002. For example, the cut out may be conical or rectangular in shape. Additionally, the process of flowing the braze ring 1002 in a melted state into the annular gap 1004 may be aided by the use of a flux. The flux may be applied to the angular cut out 1006 or the shell 112 such that the braze ring 1002, as it melts, is drawn toward the angular cut out 1006 and the shell 112 in order to fill the annular gap 1004. Typical fluxes used for brazing processes include borax, borates, fluoroborates, fluorides, and chlorides. As an aside, the process does not have to utilize a braze-welding process. Rather the ground electrode 1010 could be attached to the shell 112 using a brazing process. In either the brazing process or braze-welding process, the braze ring is generally composed of an alloy such as aluminum-silicon alloys, copper alloys, copper-zinc alloys, gold-silver alloys, nickel alloys, and silver alloys.

Additionally, the center electrode may be made of either solid metal alloy or from the welding of two cylinders together where one of the cylinders may be called the base material and the other a precious metal material. Once proper alignment is generated via the manufacturing process, the precious metal and base metals can be joined by a variety of methods such as resistance welding, inertial welding and or laser welding.

Similarly, a precious metal hollow cylinder may be created which is slipped over the base material center electrode having been reduced in diameter so that a cylinder outside a "pin" formation may be generated. The precious metal hollow cylinder is held in place by a retaining cap which is affixed by welding or mechanical means (such as threads).

Figure 23A:
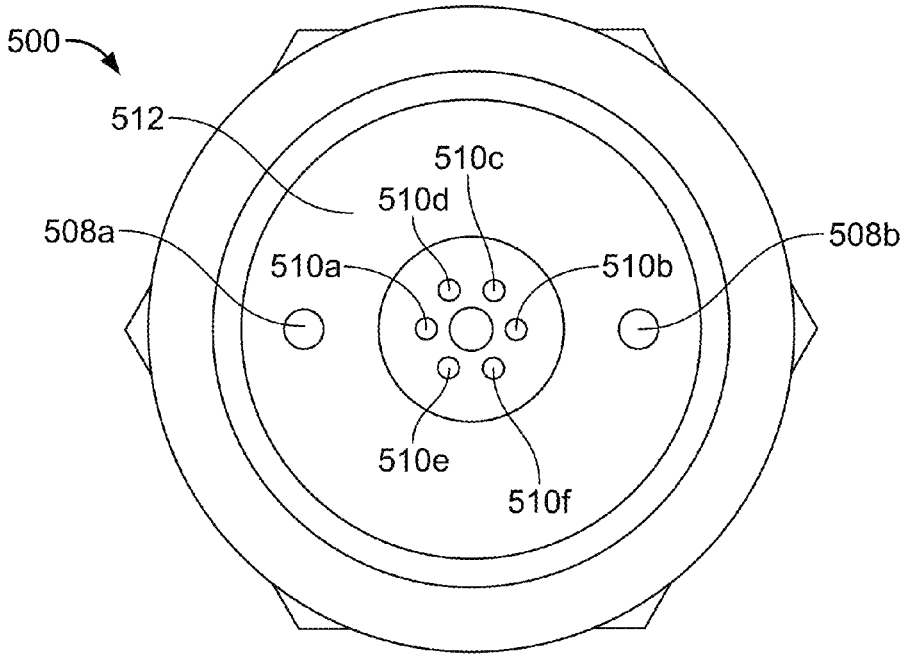
FIGS. 23*a* and 23*b* are top-down and cross-section views of a pre-chamber spark plug assembly without a velocity control tube.
Figure 23B:
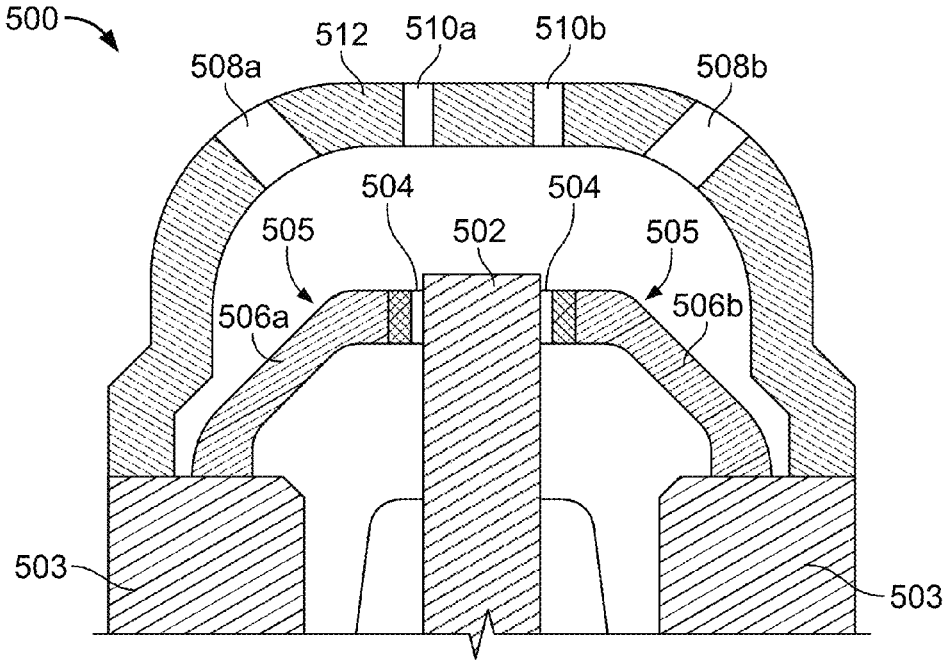

The concepts herein can be applied to other configurations of pre-chamber spark plugs, and existing configurations can even be adapted to include a velocity control tube. For example, FIGS. 23*a*, 23*b* show a spark plug 500 with an end cap 512, but without a velocity control tube. FIG. 23*a* shows a view of the spark plug 500 showing the top of the end cap 512. FIG. 23*b* shows a cross-sectional view of the spark plug 500. A tubular ground electrode 505 is supported from the shell 503 by arms 506*a*, 506*b*. Rather than attaching to the sidewalls of the shell 503, the arms 506*a*, 506*b* extend backward and attach to a rearward surface of the shell 503. The ground electrode 506 surrounds center electrode 502 and is separated by center electrode 502 by spark gap 504. The end cap 512 surrounds the electrodes 502 and 506. The top of the end cap 512 has multiple center holes 510*a*-510*f* and multiple lateral holes 508*a*, 508*b*.

Figure 24:
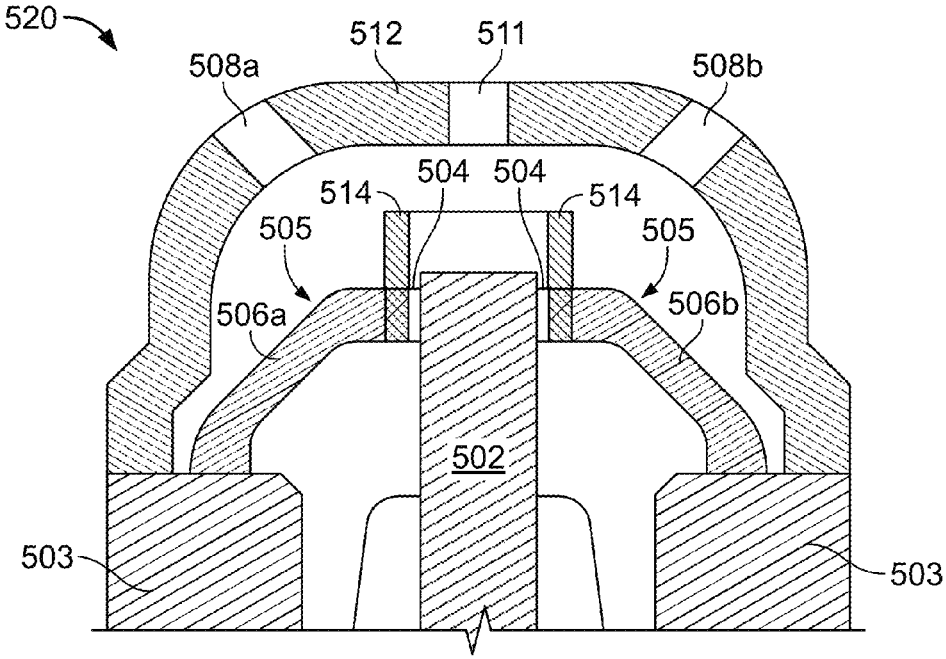
FIG. 24 is a cross-section view of the pre-chamber spark plug assembly of FIGS. 23*a* and 23*b* with a front velocity control tube.

FIG. 24 shows an example of how the spark plug 500 could be adapted according to the concepts herein to produce spark plug 520. Example spark plug 520 is substantially similar to the spark plug 500 shown in FIG. 23, but with an included front velocity control tube 514. The velocity control tube 514 can be affixed to the front of the ground electrode 506, its arms 506*a*, 506*b*, or any supporting structure such as a ring.

Figure 25:
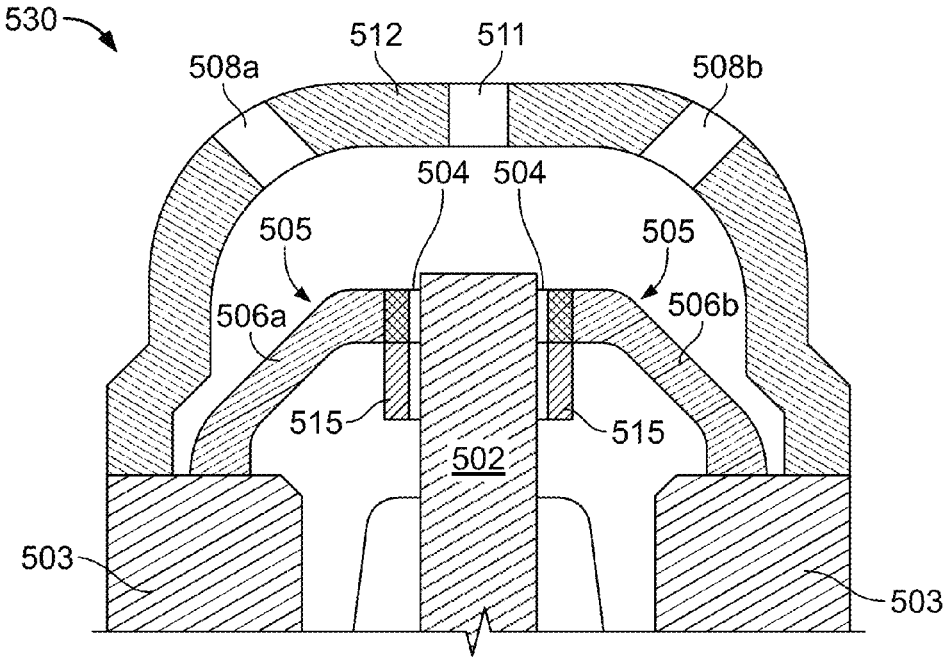
FIG. 25 is a cross-section view of the pre-chamber spark plug assembly of FIGS. 23*a* and 23*b* with a rear velocity control tube.

FIG. 25 shows an example of how the spark plug 500 could be adapted according to the concepts herein to produce spark plug 530. Example spark plug 530 is substantially similar to the spark plug 500 shown in FIG. 23, but with an included rear velocity control tube 515. The velocity control tube 515 can be affixed to the rear of the ground electrode 506, its arms 506*a*, 506*b*, or any supporting structure such as a ring.

Figure 26:
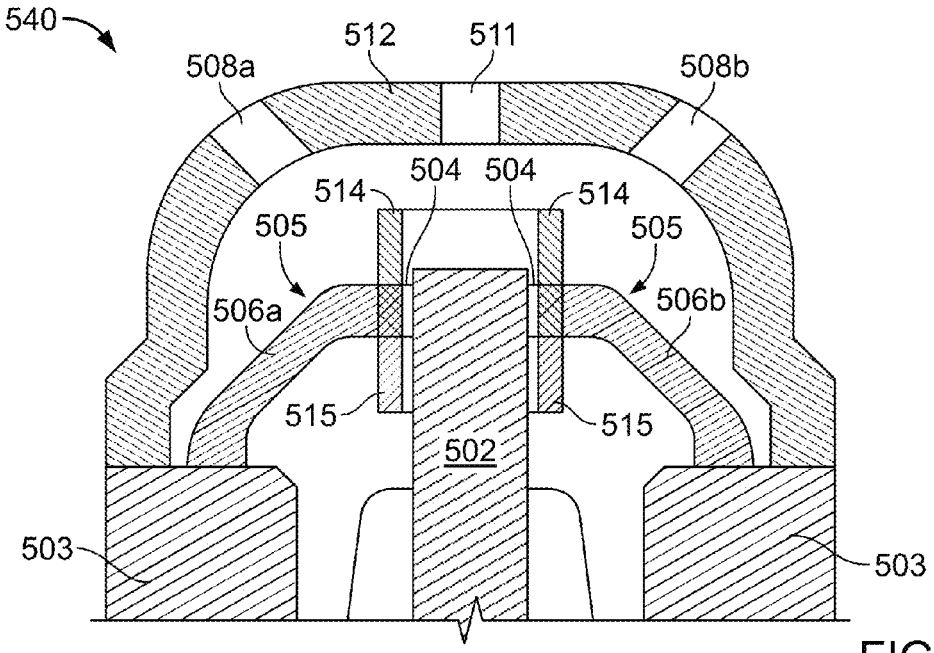
FIG. 26 is a cross-section view of the pre-chamber spark plug assembly of FIGS. 23*a* and 23*b* with both front and rear velocity control tubes.

FIG. 26 shows an example of how the spark plug 500 could be adapted according to the concepts herein to produce spark plug 540. Example spark plug 540 is substantially similar to the spark plug 500 shown in FIG. 23, but with both front and rear velocity control tubes 514 and 515. The velocity control tubes 514, 515 can be affixed to the ground electrode 506, its arms 506*a*, 506*b*, or any supporting structure such as a ring.

Figure 27A:
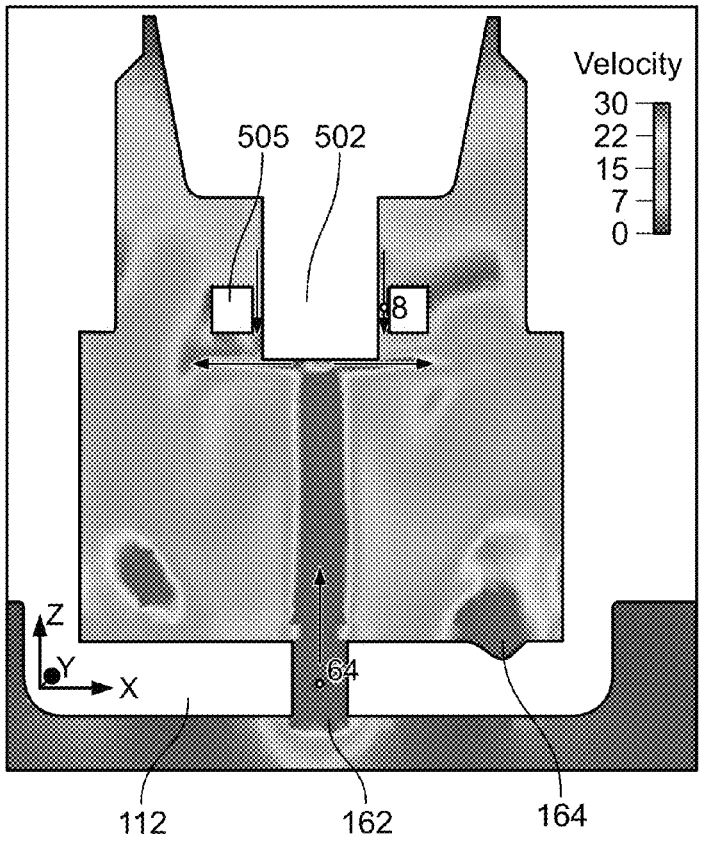
FIGS. 27*a*-27*c* are output from a computational fluid dynamics analysis showing the velocity (FIG. 27*a*), velocity vectors (FIG. 27*b*) and air/fuel mixture distribution (FIG. 27*c*) in a pre-chamber spark plug lacking a velocity control tube.
Figure 27B:
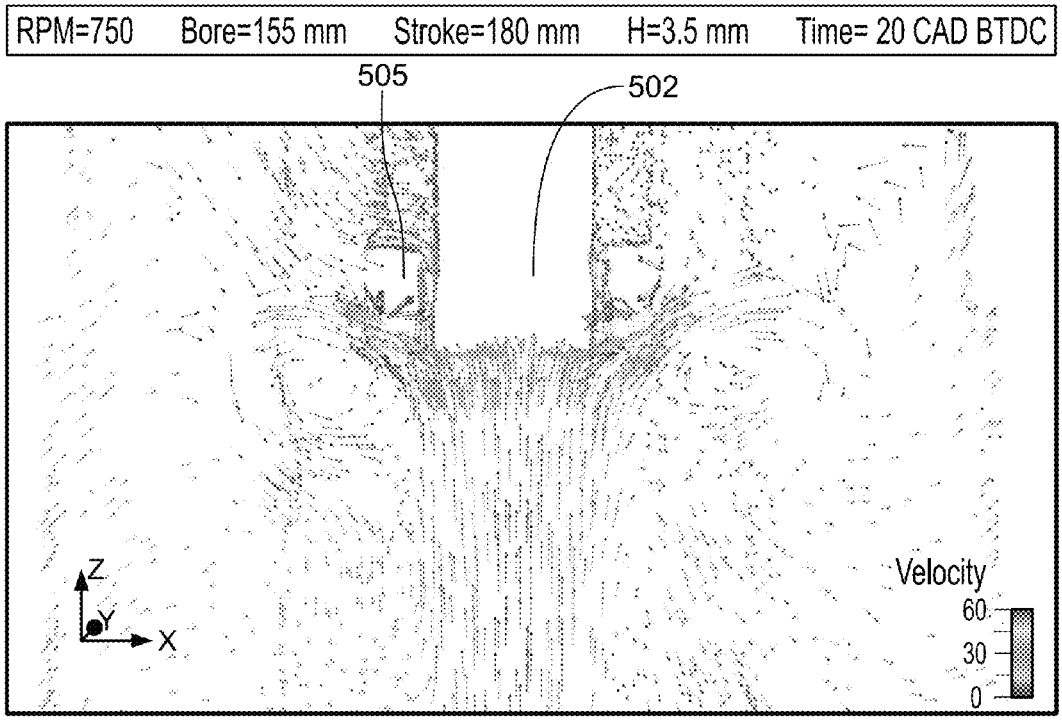
Figure 28A:
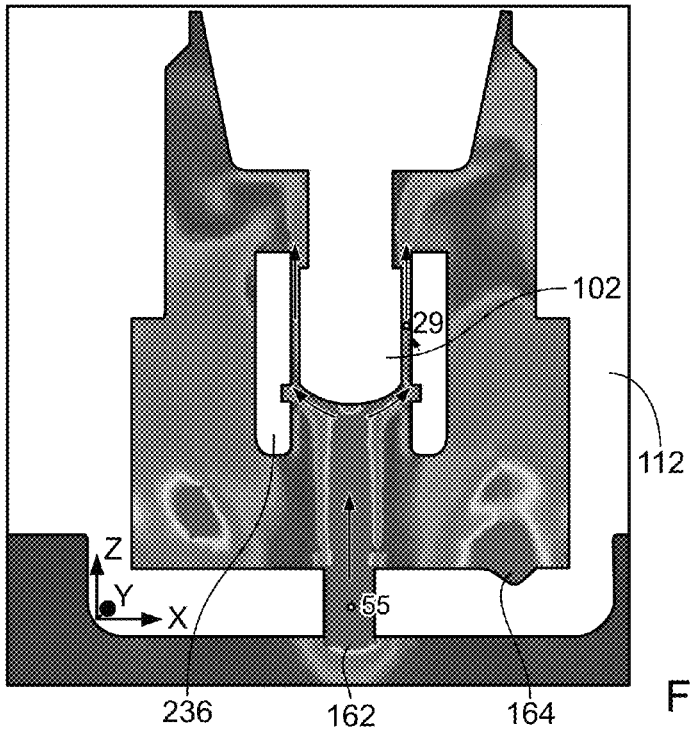
FIGS. 28*a*-28*c* are output from a computational fluid dynamics analysis showing the velocity (FIG. 28*a*), velocity vectors (FIG. 28*b*) and air/fuel mixture distribution (FIG. 28*c*) in a pre-chamber spark plug configured as in FIG. 10 at the same conditions as FIGS. 27*a*-27*c*.
Figure 28B:
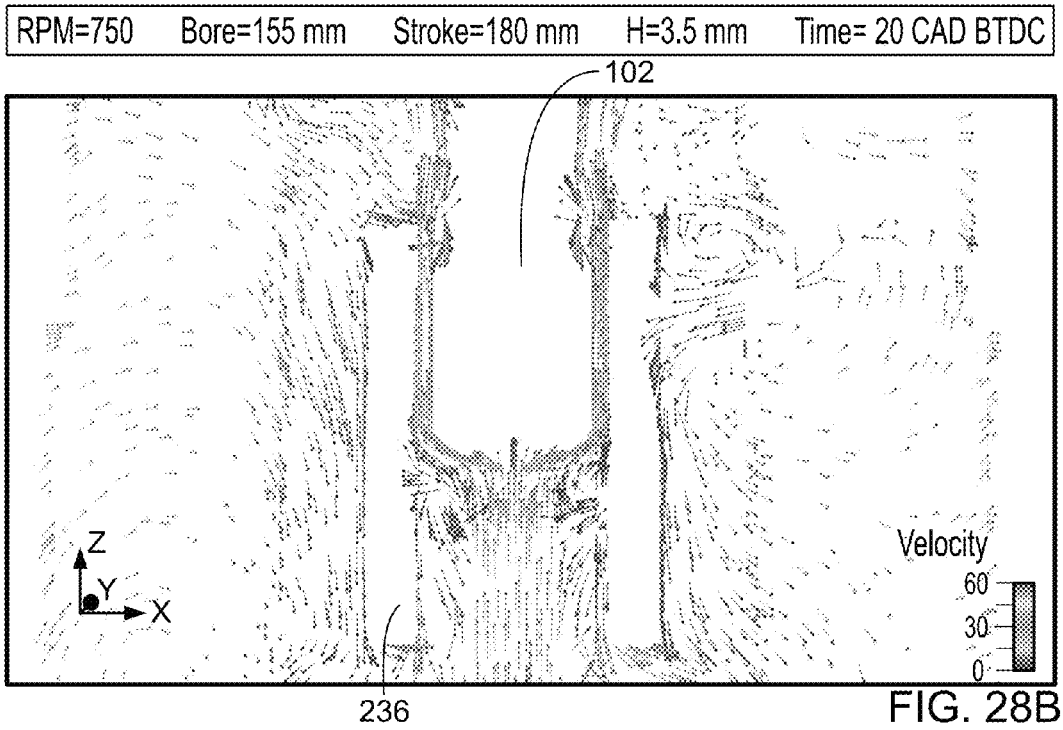
Figure 28C:
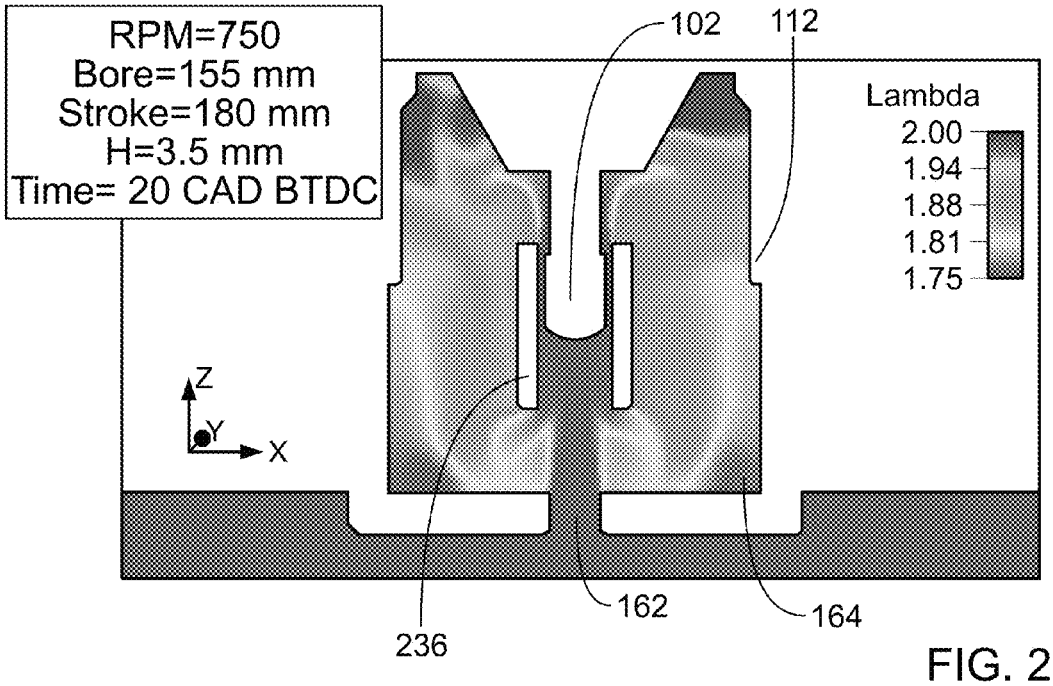

Computational fluid dynamics (CFD) analysis was performed on a pre-chamber spark plug configured as in FIG. 10 and a pre-chamber spark plug of the same size and configuration but lacking a velocity control tube. FIG. 27*a* shows a velocity plot of the spark plug lacking the velocity control tube and FIG. 28*a* shows a velocity plot of the spark plug configured as in FIG. 10. Both figures show the end of the spark plug protruding into an engine's combustion chamber. Arrows have been superimposed on the plots to show the direction of flow. FIG. 27*b* shows a velocity vector plot of the spark plug lacking the velocity control tube and FIG. 28*b* shows a velocity vector plot of the spark plug configured as in FIG. 10. FIG. 28*c* shows the air/fuel mixture distribution plot of the spark plug lacking the velocity control tube and FIG. 28C shows the air/fuel mixture distribution plot of the spark plug configured as in FIG. 10.

Figure 27C:
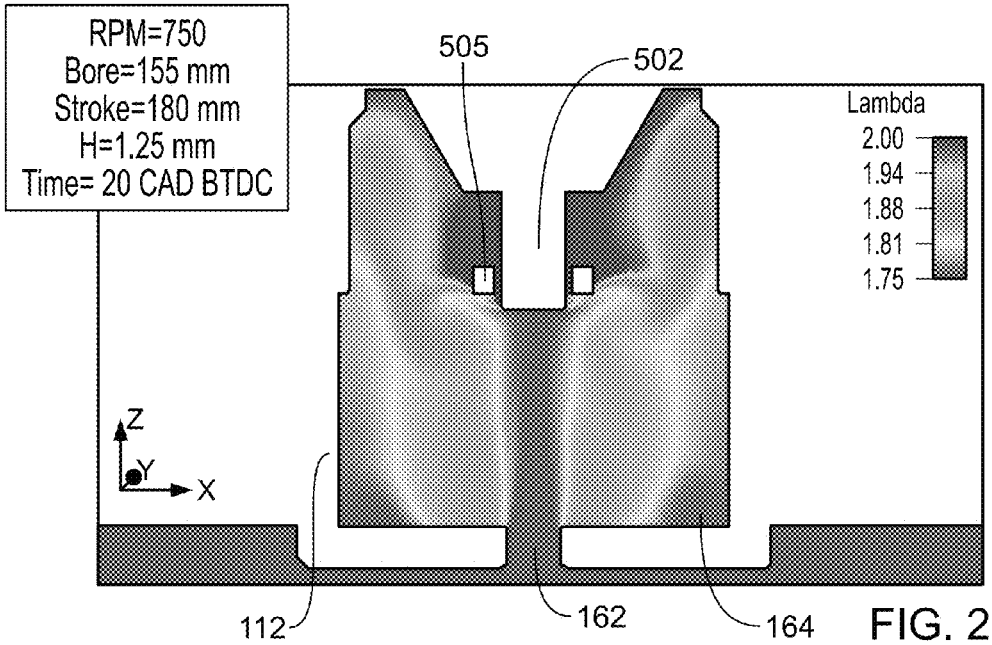

Both configurations are an M18 plug, having a 3.0 mm diameter spark surface (i.e., the adjacent surfaces forming the spark gap), a 0.42 mm maximum spark gap and the same configuration of shell 112 and end cap. The flow conditions outside of the shell 112 were modeled to represent conditions at 20 crank angle degrees, before top dead center, in an engine having a 155 mm bore, and a 180 mm stroke operating at 750 rotations per minute (RPM). FIGS. 27*a*-27*c* lack a velocity control tube, and have a typical ring ground electrode 505 that does not extend forward beyond the end of the spark surface or the center electrode 502 or rearward of the spark surface. The ground electrode 505 was 1.25 mm in axial dimension, and thus forms a 1.25 mm long spark surface. FIGS. 28*a*-28*c* have a ground electrode with a velocity control tube 236 that extends beyond the end of the center electrode 102 toward a combustion chamber end of the plug. The tube 236 surrounds and encircles the center electrode 102, and also extends rearward of the spark surface. The extent of the velocity control tube 236 beyond the end of the center electrode 102 was selected, by conventional fluid analysis, to produce the velocities discussed below. The extent of the velocity control tube 236 rearward of the spark surface was selected, by conventional fluid analysis, to shield flow exiting the spark gap from turbulent flow in the pre-chamber. The spark surface of FIGS. 28*a*-28*c* begins at the base of the radiused tip of the center electrode 102 and extends rearward to the diametrical step and is 3.5 mm long.

As can be seen from the velocity plots, FIGS. 27*a*, 28*a*, the peak velocity of incoming fresh air/fuel mixture from the combustion chamber through the center hole 162 is nearly the same in both instances—64 m/s in FIG. 27*a* and 54 m/s in FIG. 28*a*. However, in FIGS. 27*a*, 27*b*, the incoming flow impinges on the end of the center electrode 502, is predominantly directed laterally outward and then eventually cycles around the exterior of the ground electrode 505 to the rear of the pre-chamber. A stagnation zone at the end of the center electrode 502 causes a high pressure that further tends to drive the incoming flow laterally outward. The high velocity in front of the ground electrode 505, in turn, creates a low pressure zone that draws flow up from the rear of the pre-chamber through the spark gap. Although the peak velocity at the midpoint of the spark surface is 8 m/s, that flow is traveling rearward to forward. During operation of the engine, residual gasses (combusted air/fuel mixture) tend to collect in the rear of the pre-chamber. Thus, this cycle feeds the spark gap with a flow from rearward to forward of residual gasses. Reference to FIG. 27*c* confirms this, showing that the highest lambda (i.e., leanest air/fuel mixture) is both rearward in the pre-chamber and behind and in the spark gap.

By contrast, in FIGS. 28*a*, 28*b*, the incoming flow impinges on the end of the center electrode 102 and, although initially directed laterally, the flow is captured by the walls of the velocity control tube 236 and directed rearward into the spark gap. A stagnation zone at the end of the center electrode 102 causes a high pressure that further tends to drive the flow into the velocity control tube and rearward. The extent of the velocity control tube 236 is selected to achieve this flow pattern. The peak velocity at the midpoint of the spark surface is 44 m/s. Moreover, that flow is of fresh air/fuel mixture received directly from the combustion chamber via the center hole 162. Reference to FIG. 28*c* confirms this, showing the lowest lambda (i.e., richest air/fuel ratio) between the center hole 162 and the interior of the velocity control tube 236 and into the spark gap. Thus, this cycle feeds the spark gap with a flow from forward to rearward of fresh air/fuel for combustion. The fresh air/fuel mixture maintains enough velocity to flow through the entire spark surface and to the rear of the pre-chamber, sweeping out any residuals that might be in the spark gap (e.g. from the previous combustion cycle) and fueling the reward region of the pre-chamber. When the spark plug is fired, the flame kernel produced by the electrical spark is moved quickly through the spark gap and into the reward portion of the pre-chamber to reduce the tendency of the kernel to quench on the spark surfaces. In certain instances, the velocity moving the flame kernel through the spark gap allows a larger spark surface without quenching the kernel than could be achieved with a zero or low flow velocity through the gap. In general, a larger spark surface improves the life of the spark plug because there is more area over which to generate the electric spark and the material generating the spark wears less.

Figure 29:
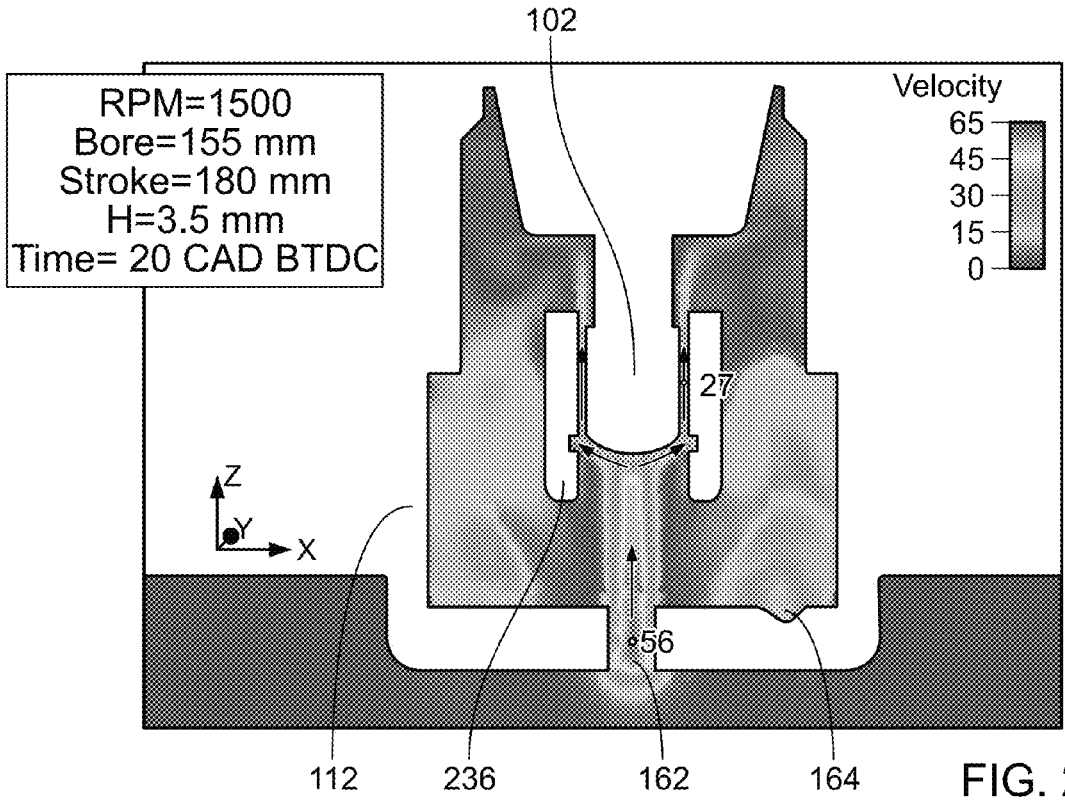
FIG. 29 is output from a computational fluid dynamics analysis showing the velocity in a pre-chamber spark plug configured as in FIG. 10 at different conditions from FIGS. 28*a* and 28*b*.

Although the example of FIGS. 28*a-c*, the peak velocity at the midpoint of the spark surface is 81% of the peak velocity of the incoming flow in the center hole 162, the concepts herein work with as little as 10% and as much as 100%. FIG. 29 shows another example with the pre-chamber plug of FIGS. 28*a-c* at the same conditions, but operated at 1500 RPM. In this example, the peak velocity of incoming fresh air/fuel mixture from the combustion chamber through the center hole 162 is 55 m/s. The peak velocity at the midpoint of the spark surface is 27 m/s. Thus, the peak velocity at the midpoint of the spark surface is 49% of the peak velocity of the incoming flow in the center hole 162. Notably, as above, the spark gap is fed with a flow from forward to rearward of fresh air/fuel for combustion and the velocity continues through the entire spark surface and to the rear of the pre-chamber. The implementations described throughout this specification (except FIG. 23) can produce similar flow patterns and performance.

While this specification contains many details, these should not be construed as limitations on the scope of what may be claimed, but rather as descriptions of features specific to particular examples. Certain features that are described in this specification in the context of separate implementations can also be combined. Conversely, various features that are described in the context of a single implementation can also be implemented in multiple implementations separately or in any suitable subcombination.

A number of examples have been described. Nevertheless, it will be understood that various modifications can be made. Accordingly, other implementations are within the scope of the following claims.

What is claimed is:

1. A spark plug for an engine, comprising:

a spark gap in an enclosure of the spark plug; and a passage in the interior of the enclosure that during operation of the engine receives flow from outside of the enclosure and directs the flow through the spark gap predominantly away from a combustion chamber end of the enclosure, the spark plug adapted to produce a peak flow velocity in the spark gap that is at least 10% of the peak flow velocity into the enclosure.

2. The spark plug of claim 1, where the spark plug is adapted to produce a peak flow velocity in the spark gap of 5 meters/second or greater.

3. The spark plug of claim 1, where the spark gap has a height H and the peak flow velocity in the gap is V, and where the spark plug is adapted to produce H/V*360*RPM less than or equal to 3 crank angle degrees of the engine.

4. The spark plug of claim 3, where the spark plug is an M14 to M24 and H is 2.5 mm or larger.

5. The spark plug of claim 1, where the spark plug is an M14 to M24 size spark plug and the passage extends at least 1.0 mm beyond an end of the spark gap toward the combustion chamber end of the enclosure.

6. The spark plug of claim 5, where the passage comprises the spark gap and extends at least 0.1 mm beyond an opposing end of the spark gap away from the combustion chamber end of the enclosure.

7. The spark plug of claim 5, comprising:

a hole in the combustion chamber end of the enclosure that is oriented to direct flow into the passage; and a hole in the combustion chamber end of the enclosure that is oriented to direct flow around an exterior of the passage and to an end of the enclosure opposite the combustion chamber end.

8. The spark plug of claim 1, where the spark plug is an M14 to M24 size; and where the spark plug is adapted to reach maximum pressure in the enclosure due to combustion of air/fuel mixture in 7 or more crank angle degrees of the engine after a spark in the spark gap.

9. The spark plug of claim 1, comprising:

a metallic shell;

an electric insulator in the shell;

a central electrode extending from the insulator; and one or more ground electrodes defining the spark gap with the central electrode and one or more ground electrodes defining the passage.

10. The spark plug of claim 9, where more than one ground electrodes define the passage and the ground electrodes do not meet.

11. The spark plug of claim 9, where the one or more ground electrodes comprises a tube defining the passage and comprising an arm extending from the tube, away from the combustion end of the enclosure, to the shell.

12. The spark plug of claim 9, where the central electrode is polygonal in axial cross-section.

13. The spark plug of claim 12, where the one or more ground electrodes define the passage as the same shape in axial cross-section as the central electrode.

14. A method of facilitating combustion in operation of an engine, comprising:

receiving air/fuel mixture from a combustion chamber of the engine into an enclosure of a spark plug igniting the received air/fuel mixture in a spark gap within the enclosure;

directing the ignited air/fuel mixture through the spark gap predominantly away from a combustion chamber end of the enclosure at a peak flow velocity at least 10% of the peak flow velocity into the enclosure.

15. The method of claim 14, where the peak flow velocity is 5 meters/second or greater and purges residual gasses from the gap.

16. The method of claim 14, where the spark gap has a height H of 2.5 mm or larger and the peak flow velocity in the gap is V, and where H/V*360*RPM is less than or equal to 3 crank angle degrees of the engine.

17. The method of claim 14, comprising directing air/fuel mixture in a swirling flow around the interior of the enclosure and to an end of the enclosure opposite the combustion chamber end; and shielding the air/fuel mixture igniting in the spark gap from the swirling flow.

18. The method of claim 17, comprising shielding the ignited air/fuel mixture exiting the spark gap from the swirling flow.

19. The method of claim 14, where the spark plug is an M14 to M24 size and comprising delaying maximum pressure in the enclosure due to combustion of the air/fuel mixture for 7 or more crank angle degrees of the engine after igniting the air/fuel mixture in the spark gap.

20. The method of claim 14, comprising jetting ignited air/fuel mixture from inside the enclosure into a combustion chamber of the engine only after igniting substantially all of the air/fuel mixture in a half of the enclosure opposite the combustion chamber end.

* * * * *

UNITED STATES PATENT AND TRADEMARK OFFICE

CERTIFICATE OF CORRECTION

PATENT NO. : 8,584,648 B2
APPLICATION NO. : 13/833226
DATED : November 19, 2013
INVENTOR(S) : Domenico Chiera et al.

It is certified that error appears in the above-identified patent and that said Letters Patent is hereby corrected as shown below:

On the Title Page item 73 under Assignee, after "Woodward, Inc.", insert -- (US) --

On the Title Page item 63 under Related U.S. Application Data, please replace "Continuation-in-part of application No. 13/042,599, filed on Mar. 8, 2011, which is a continuation-in-part of application No. 13/347,448, filed on Jan. 10, 2012. Provisional Application No. 61/416,588, filed on Nov. 23, 2010" with -- Continuation-in-part of 13/042,599, filed on Mar. 8, 2011, which claims benefit of 61/416,588, filed on Nov. 23, 2010. Also continuation-in-part of 13/347,448, filed on Jan. 10, 2012, which is a continuation-in-part of 13/042,599, filed Mar. 8, 2011, which claims benefit of 61/416,588, filed on Nov. 23, 2010. --

In the Specification

Column 12, Line 20, please replace "$mm^3$" with -- $mm^3$. -- (2nd occurrence)

Column 13, Line 28, please replace "1b." with -- 11b. --

Column 14, Line 32, after "of the", delete "of the"

Column 15, Line 8, please replace "5 msec" with -- 5 m/sec --

Column 18, Line 42, please replace "shell" with -- shell. --

Column 19, Line 23, please replace "and or" with -- and/or --

Signed and Sealed this
Twenty-second Day of April, 2014

Michelle K. Lee

Michelle K. Lee
*Deputy Director of the United States Patent and Trademark Office*